US011885500B1

(12) United States Patent
Ressler et al.

(10) Patent No.: US 11,885,500 B1
(45) Date of Patent: Jan. 30, 2024

(54) FIRE PIT VENTILATION FEATURES

(71) Applicant: Lamplight Farms Incorporated, Menomonee Falls, WI (US)

(72) Inventors: Kyle Ressler, West Bend, WI (US); Andrew Alan Harmeling, Milwaukee, WI (US); Daniel J. Knight, Murfreesboro, TN (US)

( * ) Notice: Subject to any disclaimer, the term of this patent is extended or adjusted under 35 U.S.C. 154(b) by 185 days.

(21) Appl. No.: 17/518,344

(22) Filed: Nov. 3, 2021

Related U.S. Application Data

(63) Continuation-in-part of application No. 17/339,670, filed on Jun. 4, 2021.

(51) Int. Cl.
*F24B 5/02* (2006.01)
*F24C 15/08* (2006.01)

(52) U.S. Cl.
CPC ..... *F24B 5/021* (2013.01); *F24C 15/08* (2013.01)

(58) Field of Classification Search
CPC ..... F24B 5/021
See application file for complete search history.

(56) References Cited

U.S. PATENT DOCUMENTS

| | | | | |
|---|---|---|---|---|
| D858,729 | S * | 9/2019 | Scott | D23/348 |
| 11,391,465 | B1 * | 7/2022 | Weilert | F24C 15/08 |
| 11,585,534 | B2 * | 2/2023 | Stoltzfus | F24B 3/00 |
| 2013/0081609 | A1 * | 4/2013 | Dhuper | A47J 37/0781 126/25 AA |
| 2016/0166109 | A1 * | 6/2016 | Banal | A47B 11/00 108/50.13 |
| 2019/0137107 | A1 * | 5/2019 | Crosen | F24B 1/181 |
| 2020/0096199 | A1 * | 3/2020 | Harrington | F24B 5/025 |
| 2020/0208842 | A1 * | 7/2020 | Jan | F24B 1/195 |
| 2021/0321821 | A1 * | 10/2021 | Stoltzfus | F24B 1/182 |
| 2022/0243920 | A1 * | 8/2022 | Jan | F24C 15/36 |

* cited by examiner

*Primary Examiner* — David J Laux
(74) *Attorney, Agent, or Firm* — GableGotwals; David G. Woodral

(57) ABSTRACT

An insert ring that suspends a fire pit at least partially within an opening of a support structure, and provides ventilation into the support structure to an outer wall of the fire pit.

18 Claims, 28 Drawing Sheets

FIRE PIT VENTILATION FEATURES

CROSS-REFERENCE TO RELATED CASES

This application is a continuation-in-part of U.S. patent application Ser. No. 17/339,670 entitled FIRE PIT VENTILATION INSERT RING filed on Jun. 4, 2021, the contents of which are hereby incorporated by reference.

FIELD OF THE INVENTION

This disclosure relates to outdoor combustion devices in general and, more specifically, to outdoor solid fuel fire pits.

BACKGROUND OF THE INVENTION

Various outdoor fire pits utilize particular arrangements of air inlets and air flow configurations to improve light output or flame appearance while reducing smoke and undesirable wind effects. In some cases, outdoor fire pits may be configured to take air in through the exterior of the fire pit and then deliver it in a particular way to an interior where combustion of solid fuel occurs. This means that users may be unable to install a fire pit into a permanent structure, or even certain decorative structures, without either being limited in the design of such structure (e.g., being required to provide for additional external ventilation ports) or diminishing the performance of the fire pit.

What is needed is a system and method for address the above and related considerations.

SUMMARY OF THE INVENTION

The invention of the present disclosure, in one aspect thereof, comprises a fire pit insert ring for use with a fire pit installation. The fire pit ring includes a surround defining an opening sized to accept a fire pit, and a vent panel attached to the surround and defining a plurality of vent openings. The vent panel provide airflow into the installation and to an outer wall of the firepit.

The opening defined by the surround may be sized to pass at least a portion of the outer wall of the firepit therethrough and to suspend the firepit in the installation by a rim of an upper cover of the fire pit. The vent panel may descend below the surround. A circumference of the vent panel may be sized to rest on an upper ledge of the installation and provide air flow below the surround and inwardly toward the outer wall of the firepit. The surround may slope downwardly away from the upper cover of the fire pit. In some cases, the vent panel slopes downwardly from the surround at an angle exceeding a downward sloping angle of the surround. The downward sloping angle of the surround may be approximately equal to a downward sloping angle of the upper cover of the fire pit.

The invention of the present disclosure, in another aspect thereof, comprises a fire pit insert ring for use with a fire pit installation. The insert ring includes surround having a panel spanning a distance between a firepit and an upper ledge of the installation suspending the fire pit partially inside the installation. The panel has at least one support ledge in contact with the fire pit and at least one rebated portion spaced apart from the firepit such that air flow is provided between the rebated portion and the firepit allowing air flow into the installation.

The panel may be divided into segments, each segment having a support ledge on both opposite ends thereof and a rebated portion on a medial portion thereof. The segments may join together to define a circular opening accepting the fire pit. In some embodiments, the support ledges of each segment face inwardly and support the fire pit in a suspended fashion via a rim on an upper cover of the fire pit. The panels have a downward slope away from the fire pit that approximately equates to a downward slope of the upper cover of the fire pit.

The invention of the present disclosure, in another aspect thereof, comprises a fire pit installation including a support structure having a support wall defining an opening on a top thereof and an upper ledge surrounding the opening and a fire pit having an outer wall with an air intake defined therein, an inner wall defining a combustion chamber, and an upper cover spanning between the outer wall and the inner wall, the upper cover providing a rim protruding outwardly from the outer wall. The installation includes an insert ring that suspends the fire pit by the rim at least partially within the opening of the support structure, the insert ring providing ventilation into the support structure to the outer wall of the fire pit.

In some embodiments, the insert ring has a surround defining an opening receiving the fire pit and a vent panel descending from the surround to contact the upper ledge of the support structure. The surround may define a circular opening. In some cases, the vent panel descends approximately vertically from the surround. The surround may slope outwardly down from the fire pit.

In other embodiments, the insert ring defines a circular opening and provides a plurality of inwardly projecting support ledges that engage the rim of the fire pit. The insert ring may define a plurality of rebated portions spaced apart from the fire pit providing the ventilation into the support structure. The insert ring may be divided into a plurality of separable segments each having at least one of the plurality of support ledges and at least one of the plurality of rebated portions.

DETAILED DESCRIPTION OF THE PREFERRED EMBODIMENTS

Figure 1:
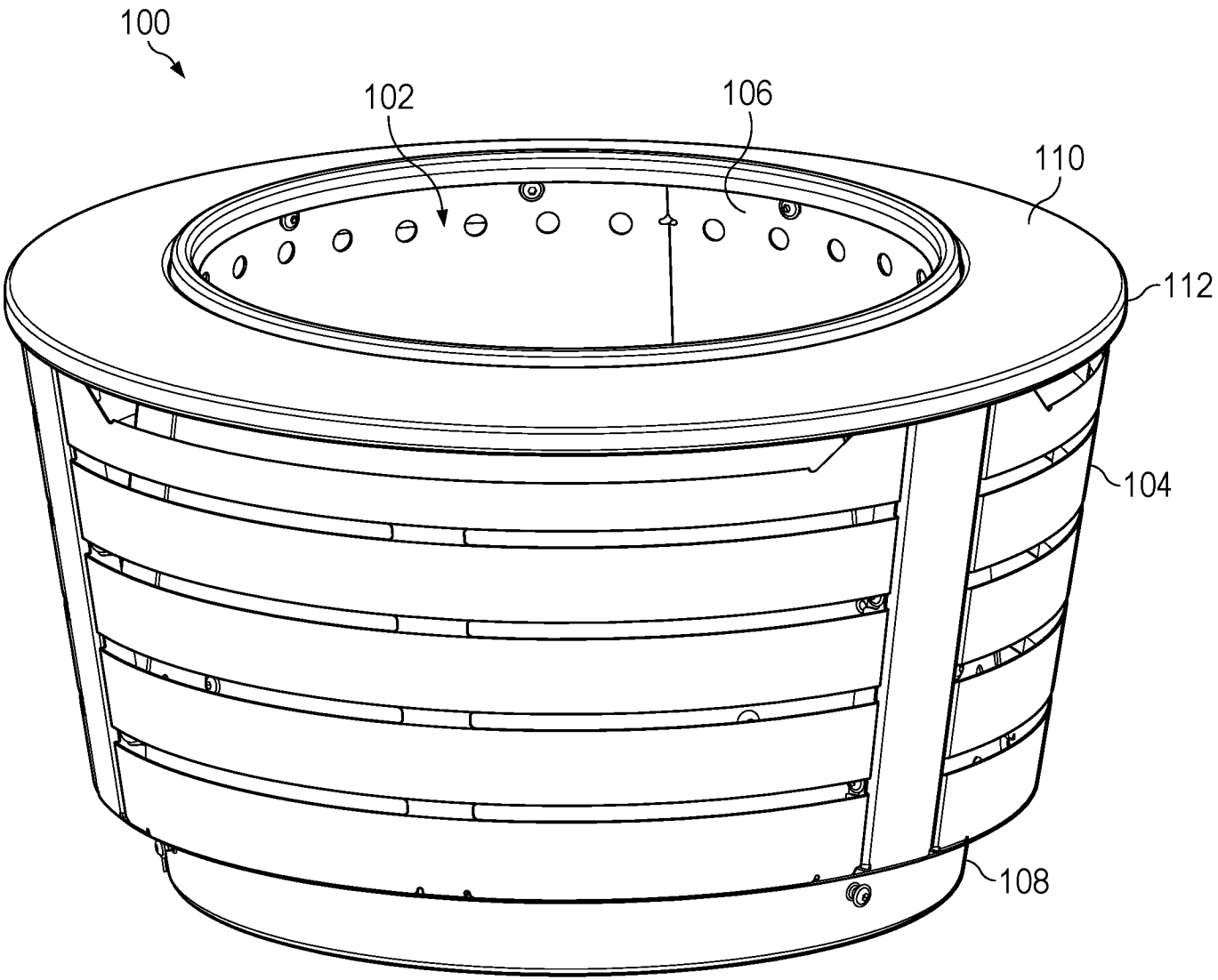
FIG. 1 is a perspective view of a fire pit.

Referring now to FIG. 1, a perspective view of a fire pit 100 is shown. The fire pit 100 may comprise a solid fuel engine or combustion chamber 102 that burns solid fuel such as natural logs, synthetic or manufactured logs, wood pellets, bagged or prepackaged fuel, or other fuels. Ventilation or air supply may be provided at various locations in the combustion chamber 102 to maximize flame, minimize smoke, and/or accomplish a variety of other goals. In some cases, air enters the fire pit 100 via openings in outer wall 104. The wall 104 may be slatted or otherwise perforated for admitting air. An inner wall 106 may at least partially define the combustion chamber 102 and define various air intakes to the combustion chamber 102. A fire pit that operates similarly to the manner described is disclosed in US Patent Application Publication No. US 2020/0096199 A1 by Harrington, et al., which is hereby incorporated by reference.

As shown, the firepit 100 has a top cover 110 spanning what would otherwise be an open space between walls 104, 106. An outer rim 112 is provided that may overhang the wall 104 by a sufficient amount that the fire pit 100 may be lifted or elevated thereby as discussed further below. The fire pit 100 may sit on a base 108 or may be provided with a stand for elevating the fire pit 100 to a more desirable height and/or reduce the chance of scorching grass or other material near the fire pit 100. Various ash handling mechanisms may also be provided.

It should be appreciated that in some embodiments the exact configuration of a fire pit suitable for use with embodiments of the fire pit ventilation ring may vary. While there may be particular advantages to a system employing a fire pit as described herein, any fire pit benefiting from or requiring external air flow may realize increased utility in terms of installation options utilizing fire pit ventilation rings and other aspects of the present disclosure. Additionally, while embodiments of the present disclosure are described as relying on the outer rim 112 for suspending the firepit, other implements of a particular fire pit may be utilized in this regard. For example, specific mounting brackets, handles, or other protrusion may serve to good effect for allowing a fire pit to be affixed to or suspended by various ventilation rings according to the present disclosure.

Figure 2:
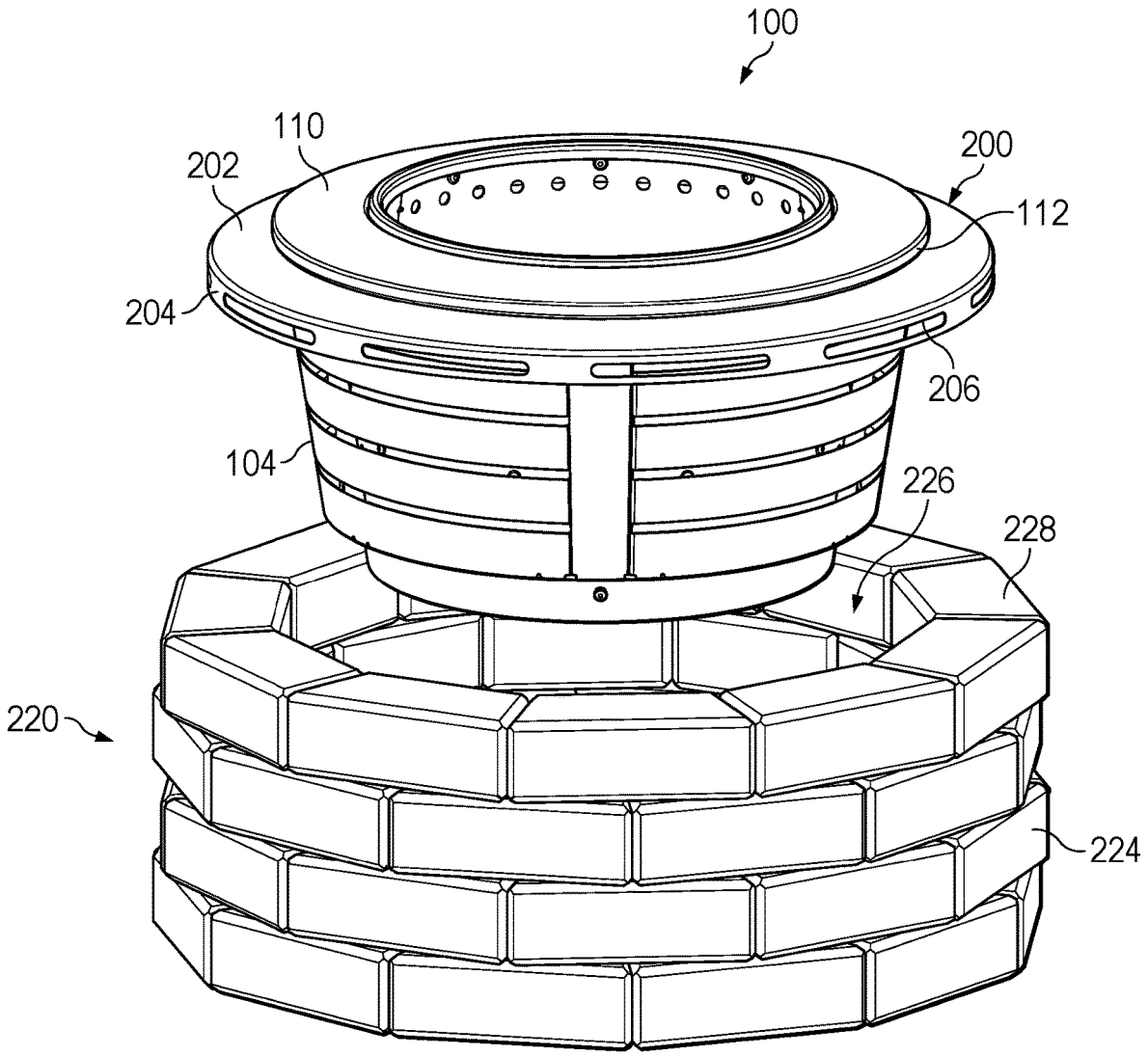
FIG. 2 is an exploded perspective view of a fire pit utilizing a fire pit ventilation insert ring according to aspects the present disclosure for mounting within a masonry installation.
Figure 3:
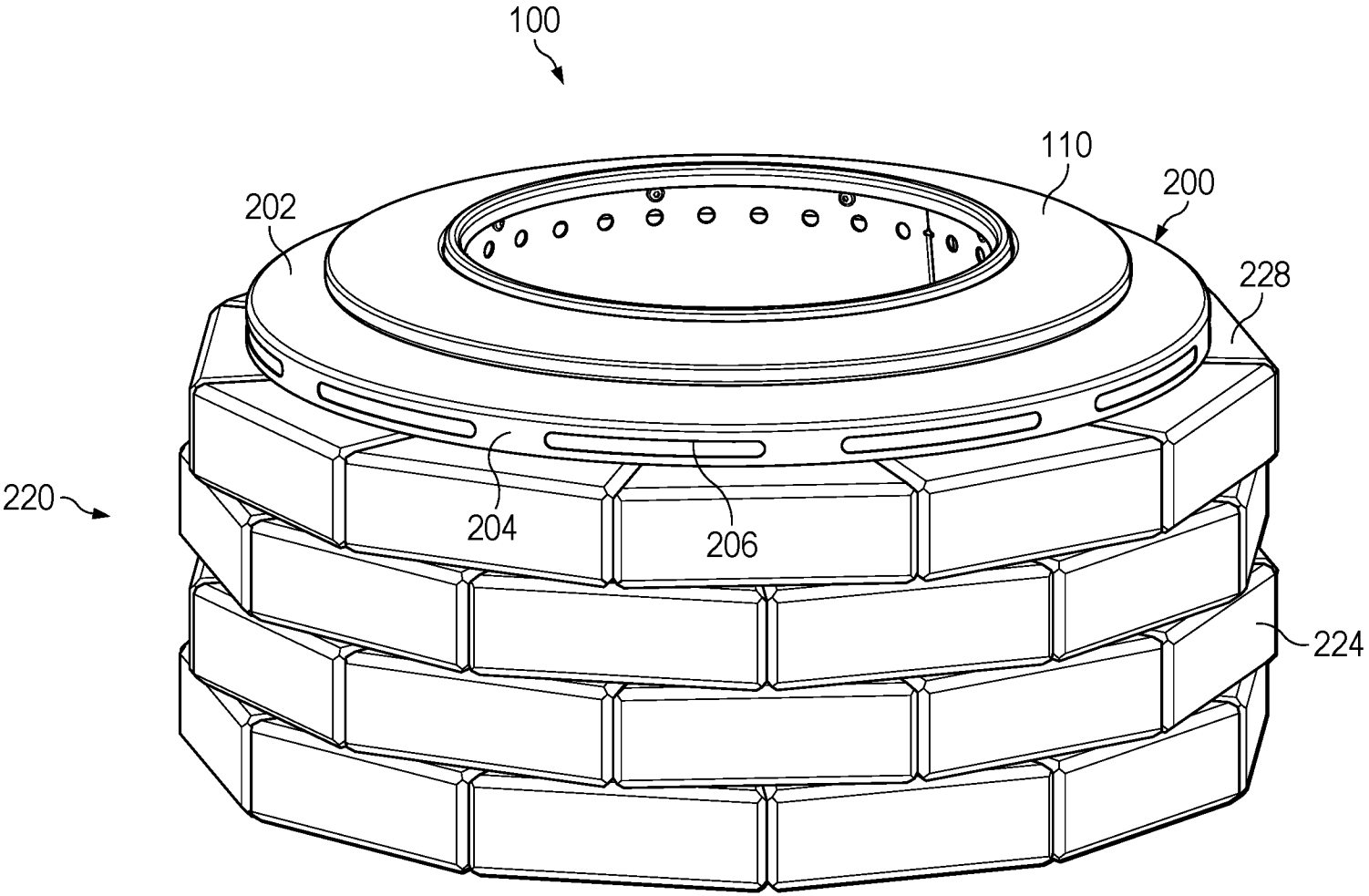
FIG. 3 is a perspective view of the fire pit of FIG. 2 with masonry installation utilizing a fire pit ventilation insert ring.

Referring now to FIG. 2, an exploded perspective view of a fire pit 100 utilizing a fire pit ventilation insert ring 200 according to aspects the present disclosure, for mounting within a masonry installation 220, is shown. FIG. 3 is a perspective view of the fire pit 100 of FIG. 3 with masonry installation 220 enabled by a fire pit ventilation insert ring 200 of the present disclosure. The ventilation ring 200 may comprise a surround 202 defining an opening that receives the firepit 100 and suspends it via the rim 112. The opening (occupied by fire pit 100) defined by the surround 202 may be circular or have another shape compatible with the fire pit 100, rim 112, and associated structures. The central opening of the surround 202 may be sized to fit the outer wall 104 near where the wall 104 fits into the rim 112.

The surround 202 may be flat or horizontal or it may slope away from the central opening of the fire pit 100. In some embodiments, an outward downward slope or angle of the surround 202 matches or approximately matches an outward downward slope or angle of the top cover 110.

Referring now to FIGS. 2 and 3, descending at an angle downward from the surround 202 on the outer edge thereof, or distal from the fire pit 100, is a vent panel 204. The vent panel 204 may be vertical. The vent panel 204 may define a plurality of openings 206 that admit ventilation air. The arrangement of the descending vent panel 204 and/or the downward sloping surround 202 allow for ventilation or intake air to the outer wall 104 of the firepit 100 even when the fire pit 100 is installed in a non-ventilated structure and/or the walls of the structure are thick (e.g., so long as the structure walls to not directly contact the outer wall 104 of the firepit 100).

The number of openings 206 may vary. In some embodiments, the openings 206 are present on half or more of the circumference of the vent panel. In various embodiments, the openings 206 may be oblong, circular, square, rectangular, or have other shapes. Additionally, not all openings 206 are necessarily identically shaped. Ventilation may also be provided on the surround 202. As illustrated, the masonry installation 220 comprises a cylindrical wall 224 with a circular open top 226 surrounded by a circular top or ledge 228. The ventilation insert ring 200 may rest on or be affixed to the ledge 228 and interpose the fire pit 100 and the masonry wall 224. When installed, the fire pit 100 may be spaced apart from the wall 224 sufficiently that air can flow into the fire pit wall 104 by entering the vent openings 206 and travelling downward into the opening 226 of the masonry installation 220.

Figure 4:
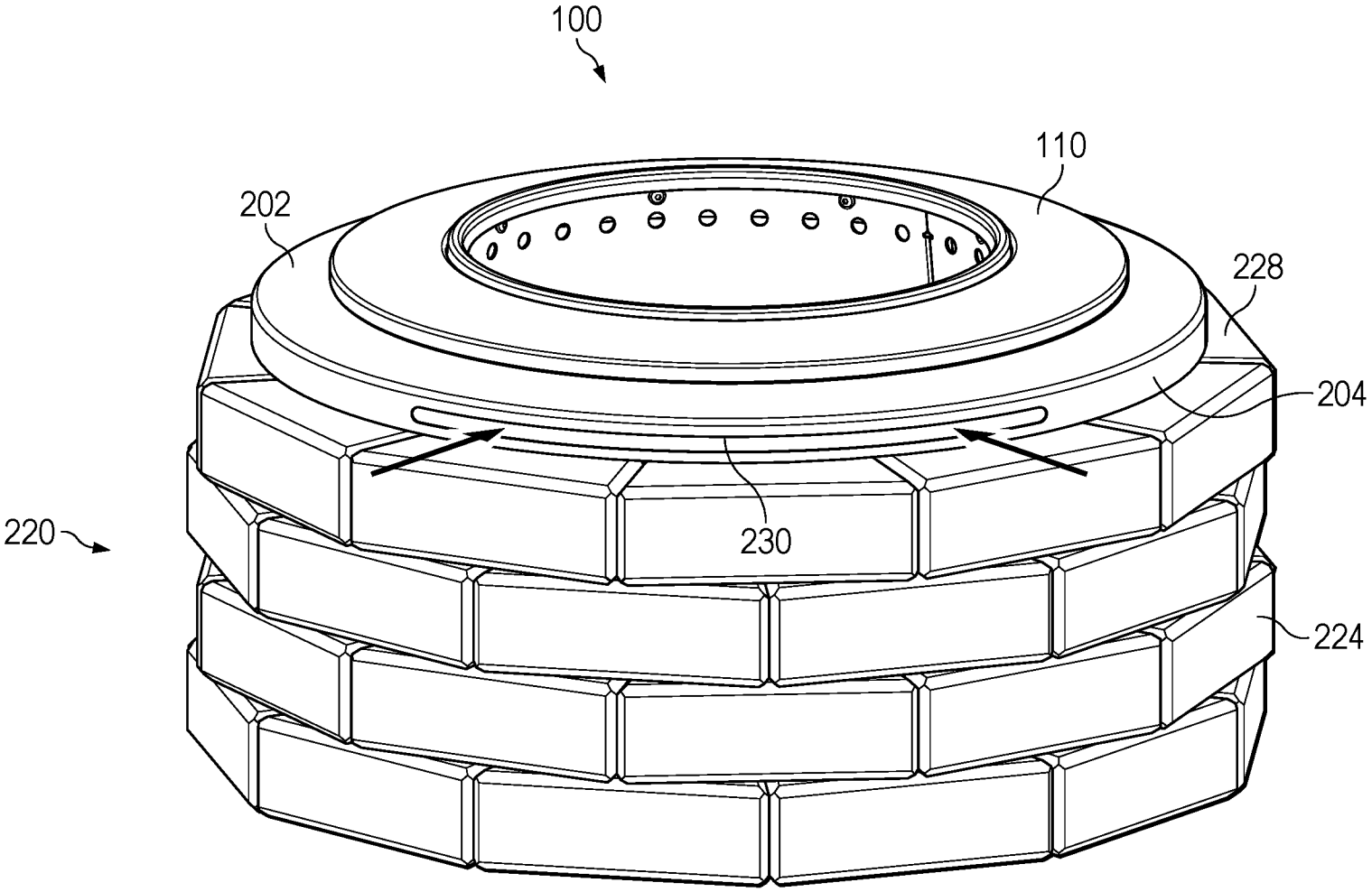
FIG. 4 is a perspective view of a fire pit utilizing a vent panel having a single large vent.

Referring now to FIG. 4, shown is an embodiment of firepit 100 wherein vent panel 204 defines a single large vent 230. Single large vent 230 preferably has a length that traverses at approximately 90 degrees of the circumference of vent panel 204, although single large vent may traverse between 60 and 120, 75 and 105 degrees.

Figure 5:
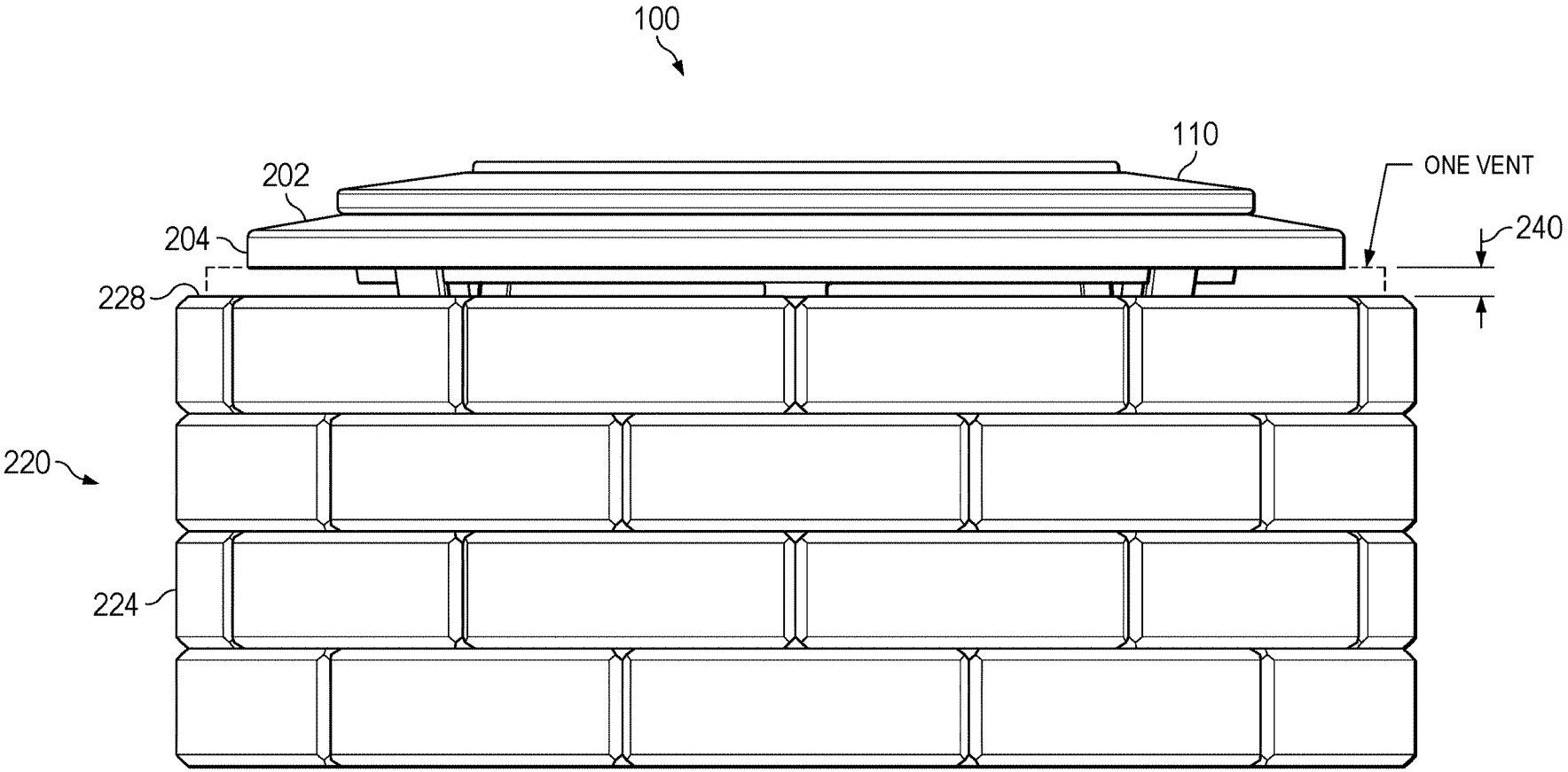
FIG. 5 is an elevation view of a fire pit utilizing a single continuous vent or gap between a surround and a top ledge of a masonry installation.

Referring to FIG. 5, shown is an embodiment of firepit 100 wherein a single continuous vent or gap 240 is defined between surround 202 and top ledge 228 of masonry installation 220. In one embodiment, vent or gap 240 is formed by elevating surround 202 off of top ledge 228 by a height of, e.g., one inch, for allowing air flow therebetween.

Figure 6:
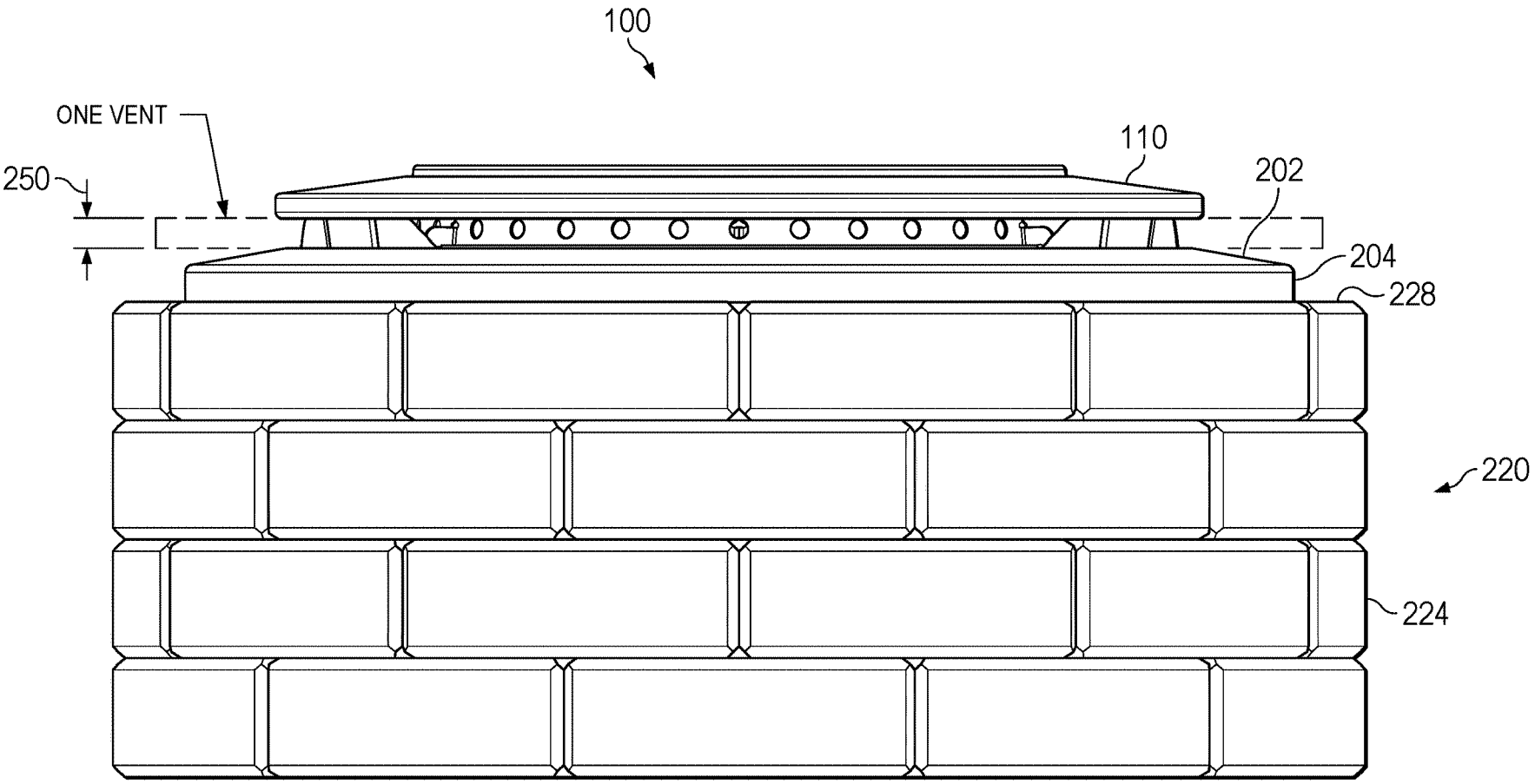
FIG. 6 is an elevation view of a fire pit utilizing a single continuous vent or gap between a cover and a surround.

Referring to FIG. 6, shown is an embodiment of firepit 100 wherein a single continuous vent or gap 250 is defined between surround 202 and top cover 110. In one embodiment, vent or gap 250 is formed by elevating top cover 110 away from surround 202 by a height of, e.g., one inch, for allowing air flow therebetween.

Figure 7:
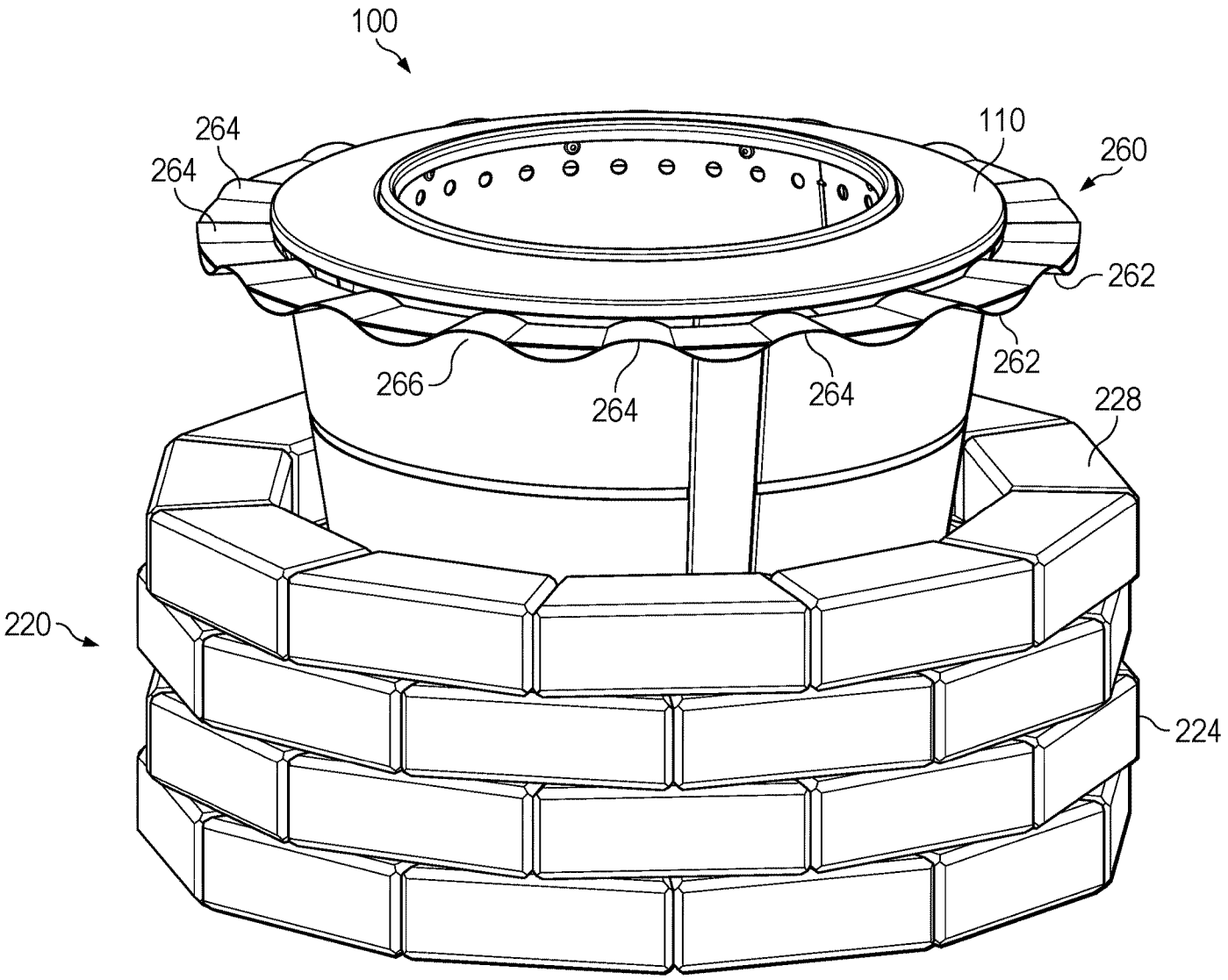
FIG. 7 is a perspective exploded view of a fire pit utilizing a wave washer vent.

Referring to FIG. 7, shown is an exploded view of an embodiment of firepit 100 wherein cover 110 is surrounded by wave washer vent ring 260. Wave washer vent ring defines a plurality of contact points 262 for supporting wave washer vent ring 260 on top ledge 228 of masonry installation 220 and a plurality of raised areas 264 to create a plurality of vents 266 to facilitate air flow therethrough.

Figure 8:
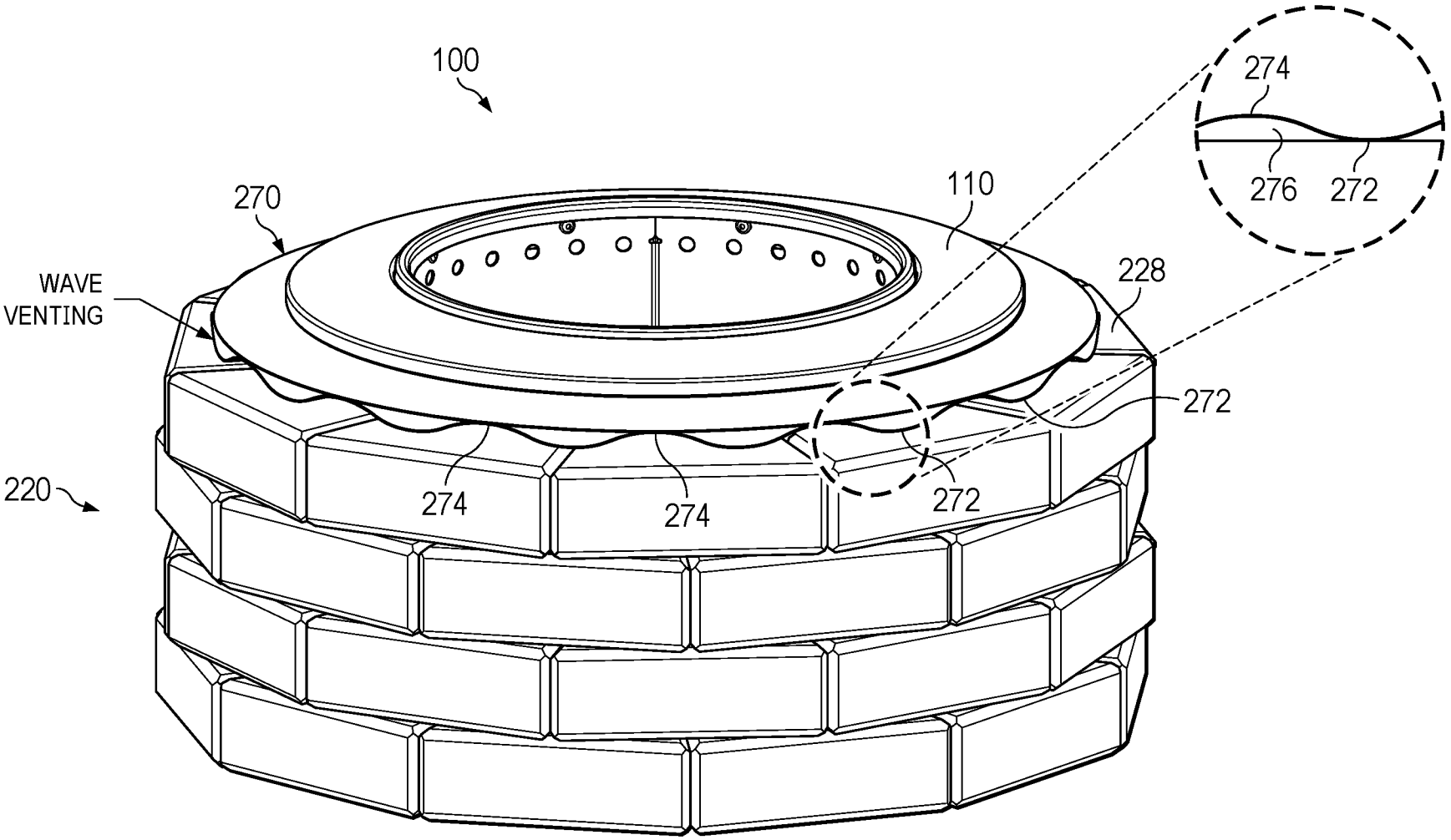
FIG. 8 is a perspective view of a fire pit utilizing a second embodiment of a wave washer vent.

Referring to FIG. 8, shown is an embodiment of firepit 100 wherein cover 110 is surrounded by a second embodiment of a wave washer vent ring, i.e., wave washer vent ring 270. Wave washer vent ring 270 defines a plurality of contact points 272 for supporting wave washer vent ring 270 on top ledge 228 of masonry installation 220 and a plurality of raised areas 274 to create a plurality of vents 276 beneath a top surface 278, wherein vents 276 to facilitate air flow therethrough.

Figure 9:
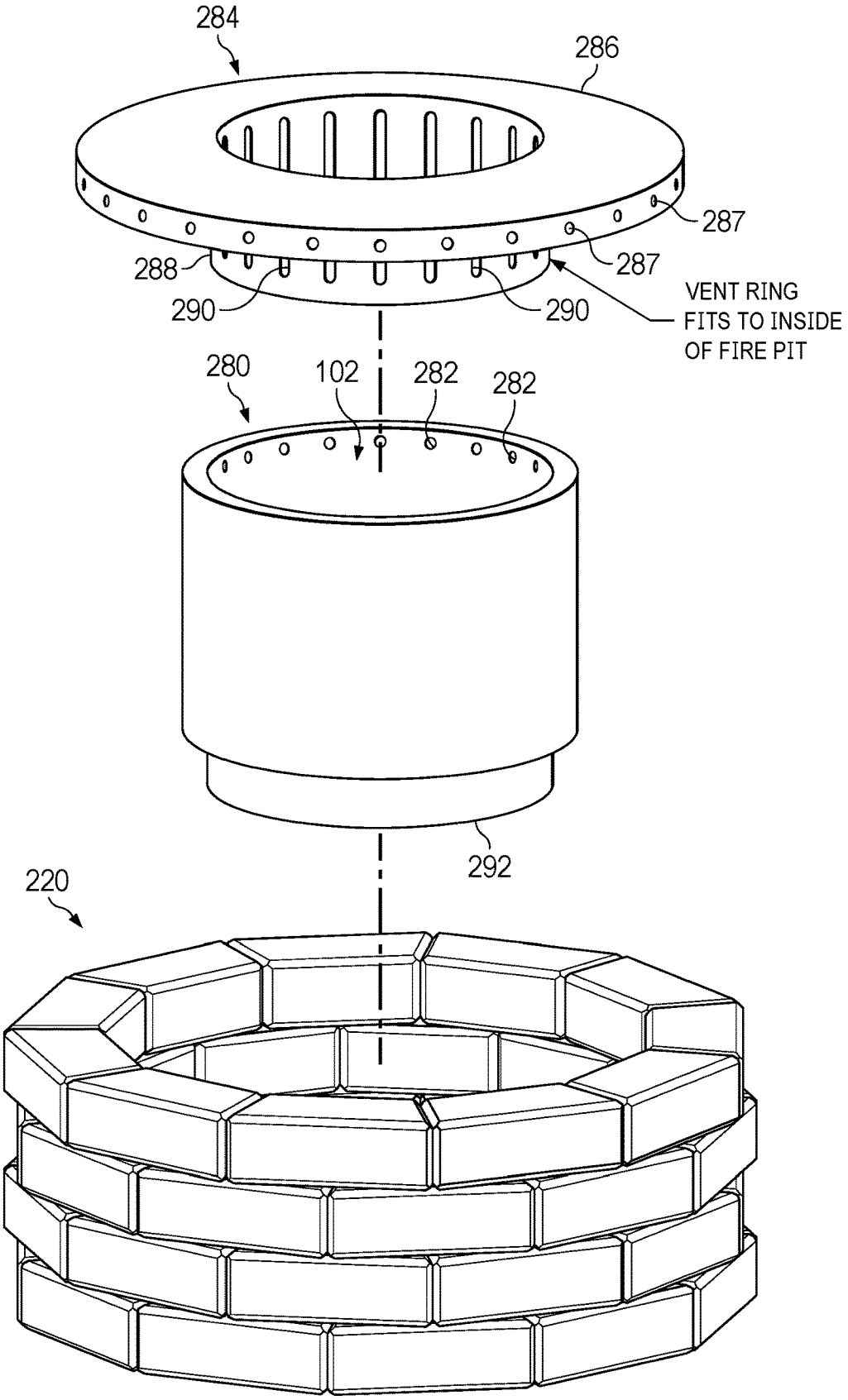
FIG. 9 is an exploded perspective view of a fire pit utilizing an internal sleeved insert.
Figure 10:
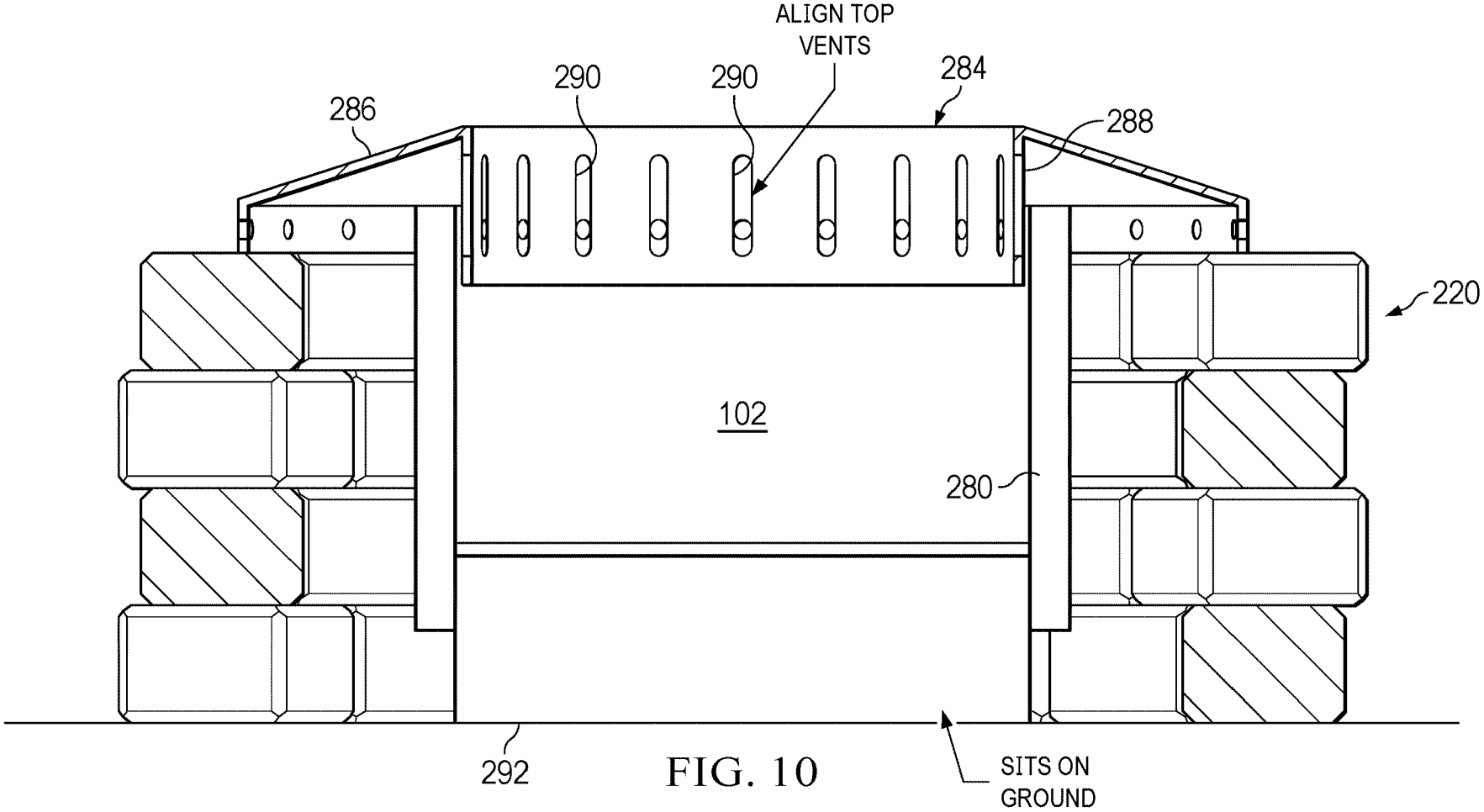
FIG. 10 is a cross-sectional plan view of a fire pit of FIG. 10.

Referring to FIG. 9, shown is an embodiment of firepit 100 wherein fire box 280 defines combustion chamber 102. Fire box 280 is received within installation 220. Fire box 280 defines a plurality of fire box vents, e.g., orifices 282, adjacent an upper end of fire box 280. Vented cover 284 has an upper vent cover member 286 defining a plurality of upper vent cover vents 287. Internal vent ring 288 is affixed to an underside of upper vent cover member 286. Internal vent ring 288 defines a plurality of internal vent ring vents 290 that may be shaped as vertical slots. Internal vent ring vents 290 may be selectively aligned with orifices 282 (see, e.g., FIG. 10) thereby facilitating air flow into combustion chamber 102 through upper vent cover vents 287. In one embodiment, fire box 280 has a lower surface 292 that rests on the ground when fire box 280 is located within mason installation 220.

Figure 11:
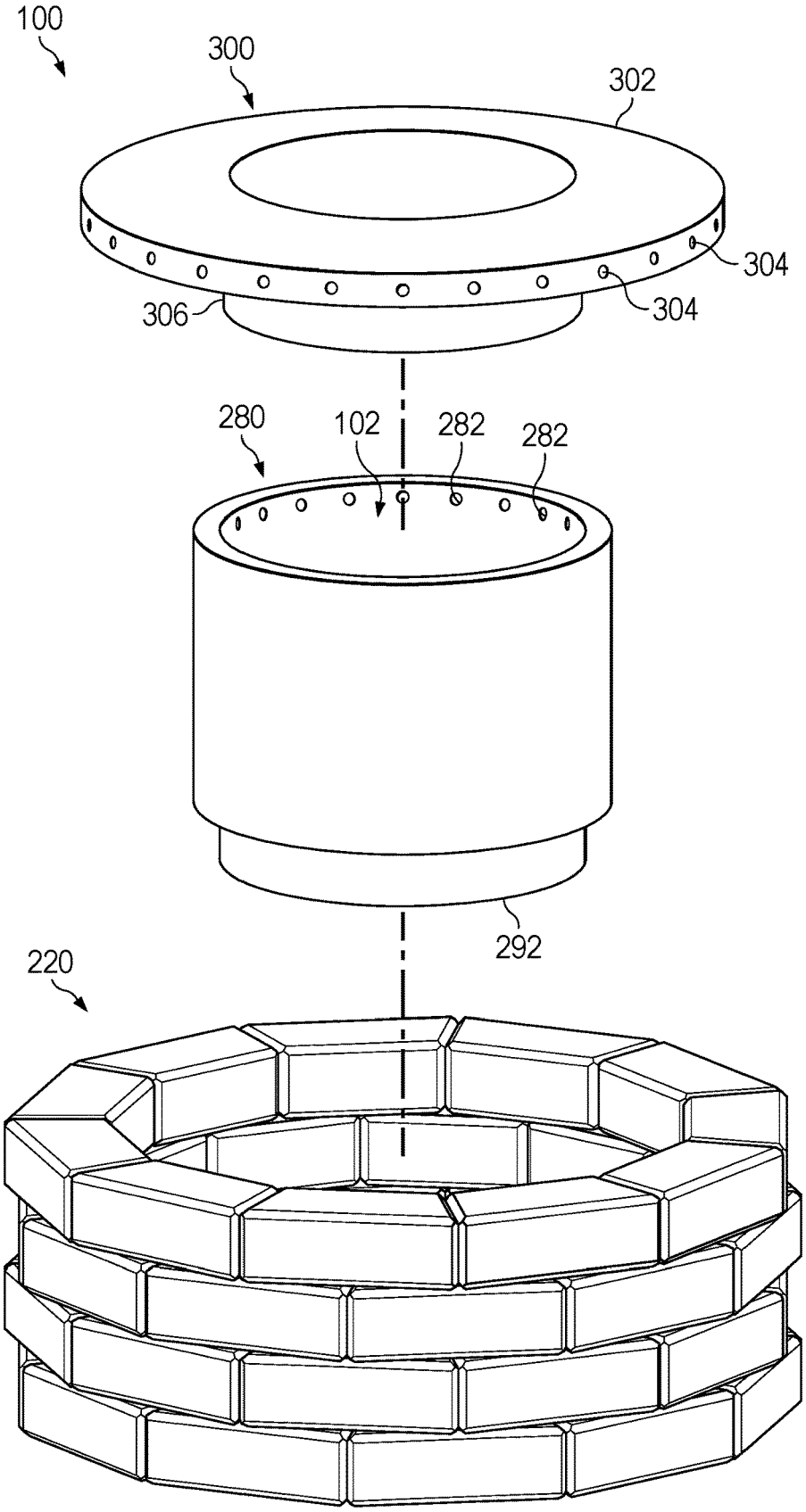
FIG. 11 is an exploded perspective view of the fire pit utilizing an external sleeved insert.
Figure 12:
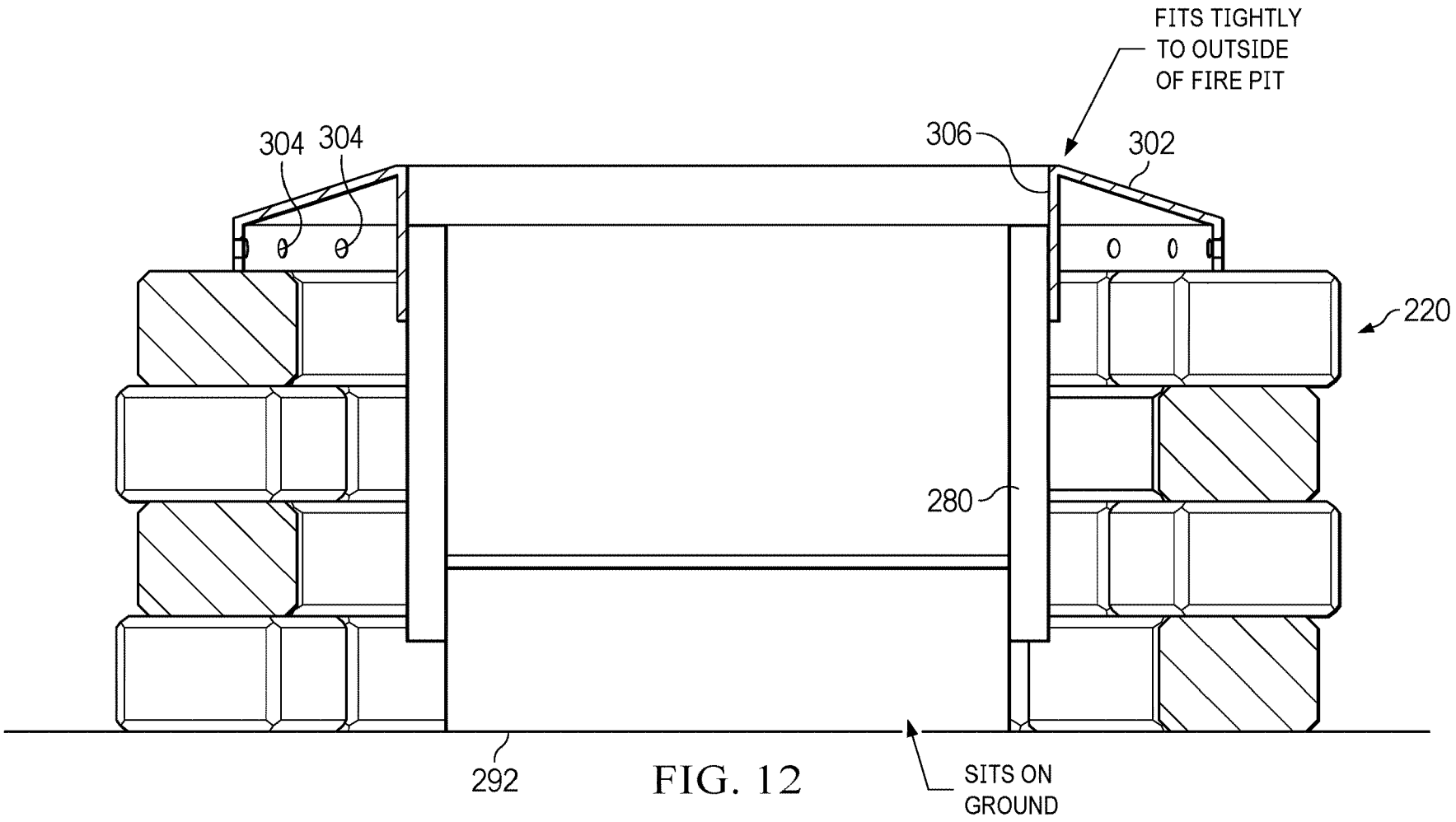
FIG. 12 is a cross-sectional plan view of the fire pit of FIG. 12.

Referring to FIGS. 11 and 12, shown is an embodiment of firepit 100 wherein fire box 280 defines combustion chamber 102. Fire box 280 is received within installation 220. Fire box 280 defines a plurality of fire box vents, e.g., orifices 282, adjacent an upper end of fire box 280. Vented cover 300 has an upper vent cover member 302 defining a plurality of upper vent cover vents 304. External vent ring 306 is affixed to an underside of upper vent cover member 302. External vent ring 306 is sized to fit tightly on an outside of fire box 280. Air flow passes through upper vent cover vents 304 and into combustion chamber 102. In one embodiment, fire box 280 has a lower surface 292 that rests on the ground when fire box 280 is located within mason installation 220.

The masonry installation 220 is intended to be exemplary and serves as a stand, or support structure. Any structure capable of supporting the fire pit's 100 size and weight could be utilized along with the fire pit ventilation ring insert 200 or others according to the present disclosure. Such installation structure could comprise brick, concrete, treated wood, wrought iron, or other materials. Whether the installation structure provides ventilation, is air permeable, or sealed, the fire pit ventilation insert ring 200 ensures that adequate combustion air flow is provided to the fire pit 100 under most or all conditions to allow the fire pit 100 to function as intended with combustion air entering through the walls rather than primarily through the top, which can lead to excessive smoking and other issues.

Figure 13:
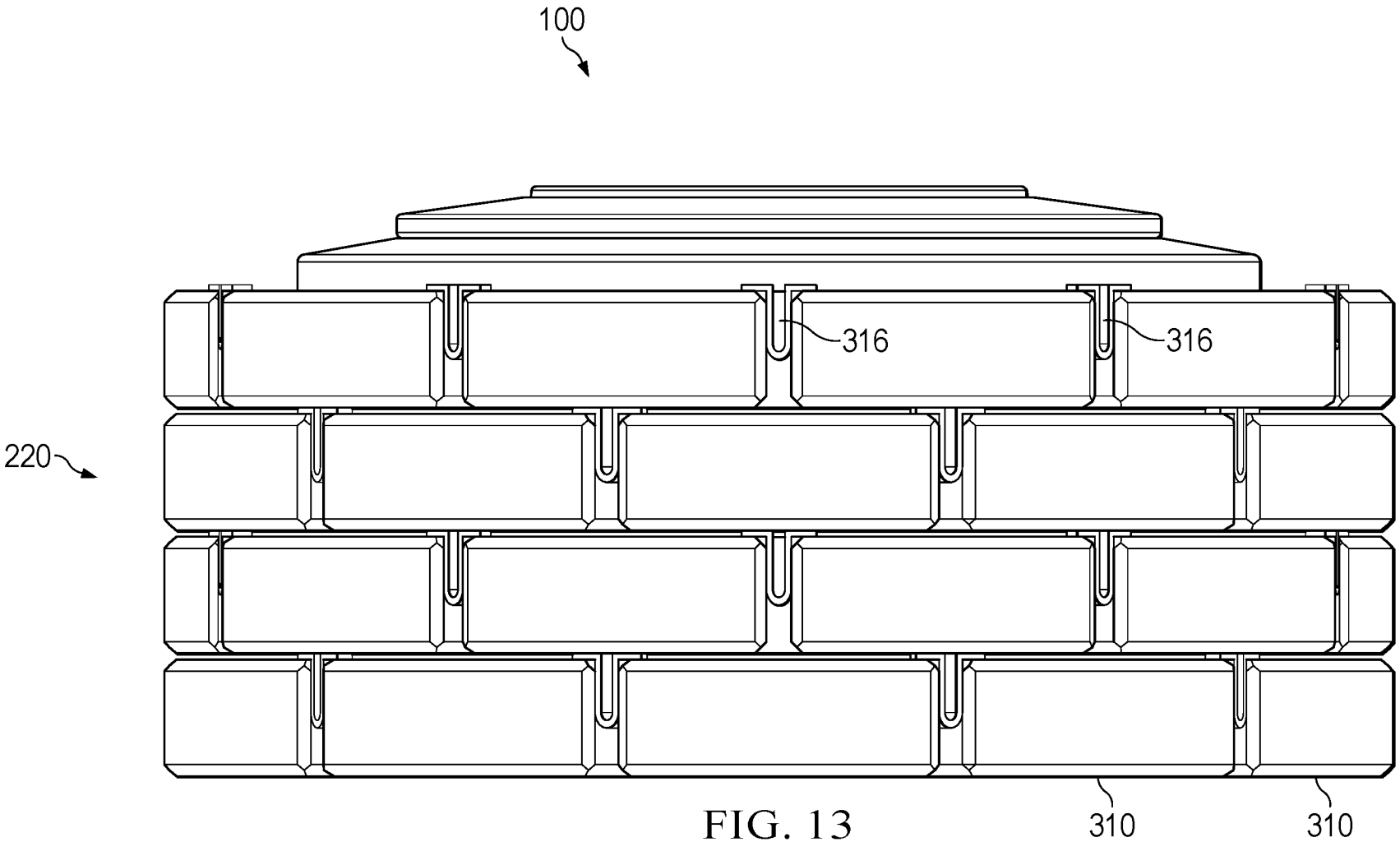
FIG. 13 is an elevation view of a fire pit with masonry installed utilizing a vent spacer.
Figure 14:
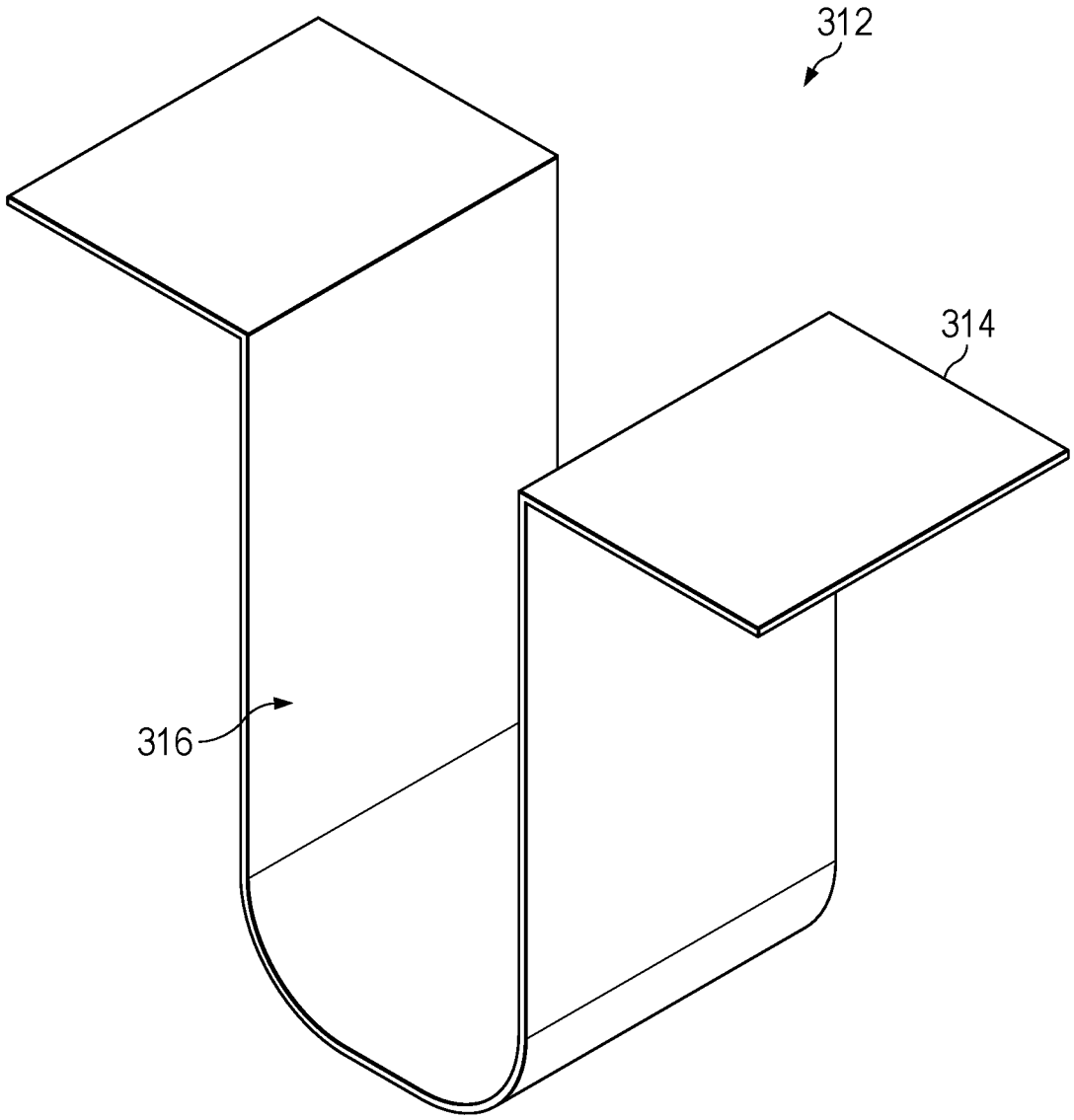
FIG. 14 is an enlarged perspective view of the vent spacer of FIG. 13.

Referring now to FIG. 13, shown is an embodiment of fire pit 100 wherein masonry installation 220 is constructed such that individual bricks 310 are separated by vent spacers 312. Vent spacers 312 preferably have horizontal tabs 314 (see, e.g., FIG. 14) for being received between adjacent vertically stacked bricks 310 and a spacer portion 316 for spacing adjacent bricks apart horizontally for facilitating air flow therebetween. In one embodiment, spacer portion 316 is U-shaped.

Figure 15:
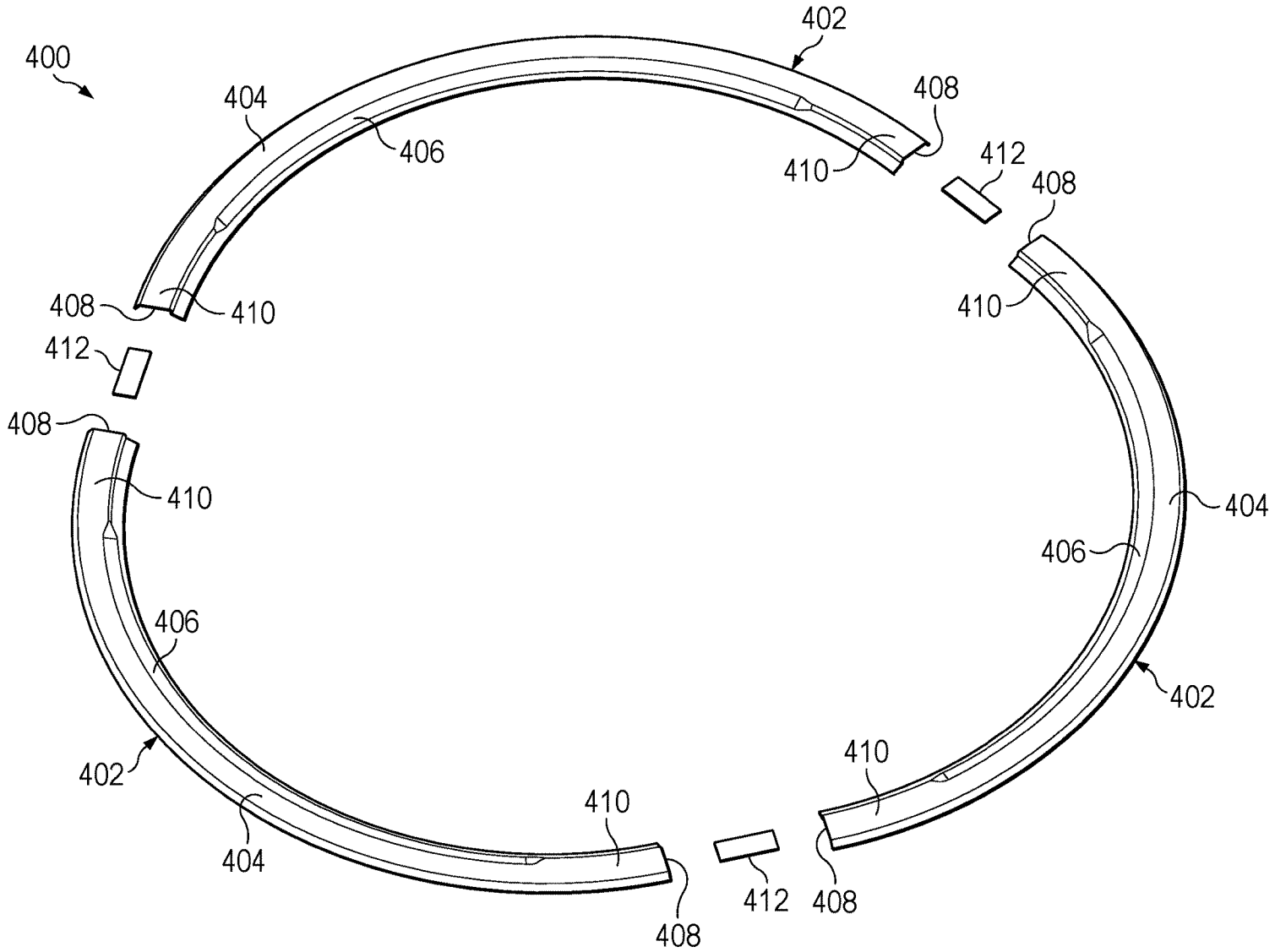
FIG. 15 is an exploded view of another fire pit ventilation insert ring according to aspects of the present disclosure.

Referring now to FIG. 15, an exploded view of another fire pit ventilation insert ring 400 according to aspects of the present disclosure is shown. The fire pit ventilation insert ring 400 is shown installed for use in FIG. 16. In the embodiment shown, the ventilation insert ring 400 comprises a plurality of segments 402 that may be generally in the form or an arc of a circle of the completed ventilation insert ring 400. As illustrated, three equally sized segments 402 are provided. One of skill in the art will appreciate that this number may vary and that all segment need not necessarily be of the same size or arc length. However, use of three segments 402 of equal length provides for convenient assembly and installation as well as reducing packaging size for shipment and the like.

Each segment 402 comprises a panel 404 with a rebated or recessed portion 406. The rebated portion 406 is spaced apart from the top cover 110 of the fire pit 100 when the insert ring 400 is installed. On opposite ends 408 of the panel 404 are support ledges 410 that receive the rim 112 of the firepit 100 when installed. Thus, the firepit 100 is supported but the rebated portions 406 are spaced apart from the firepit 100, the top cover 110, and the rim 112 to define ventilation openings 502.

Figure 16:
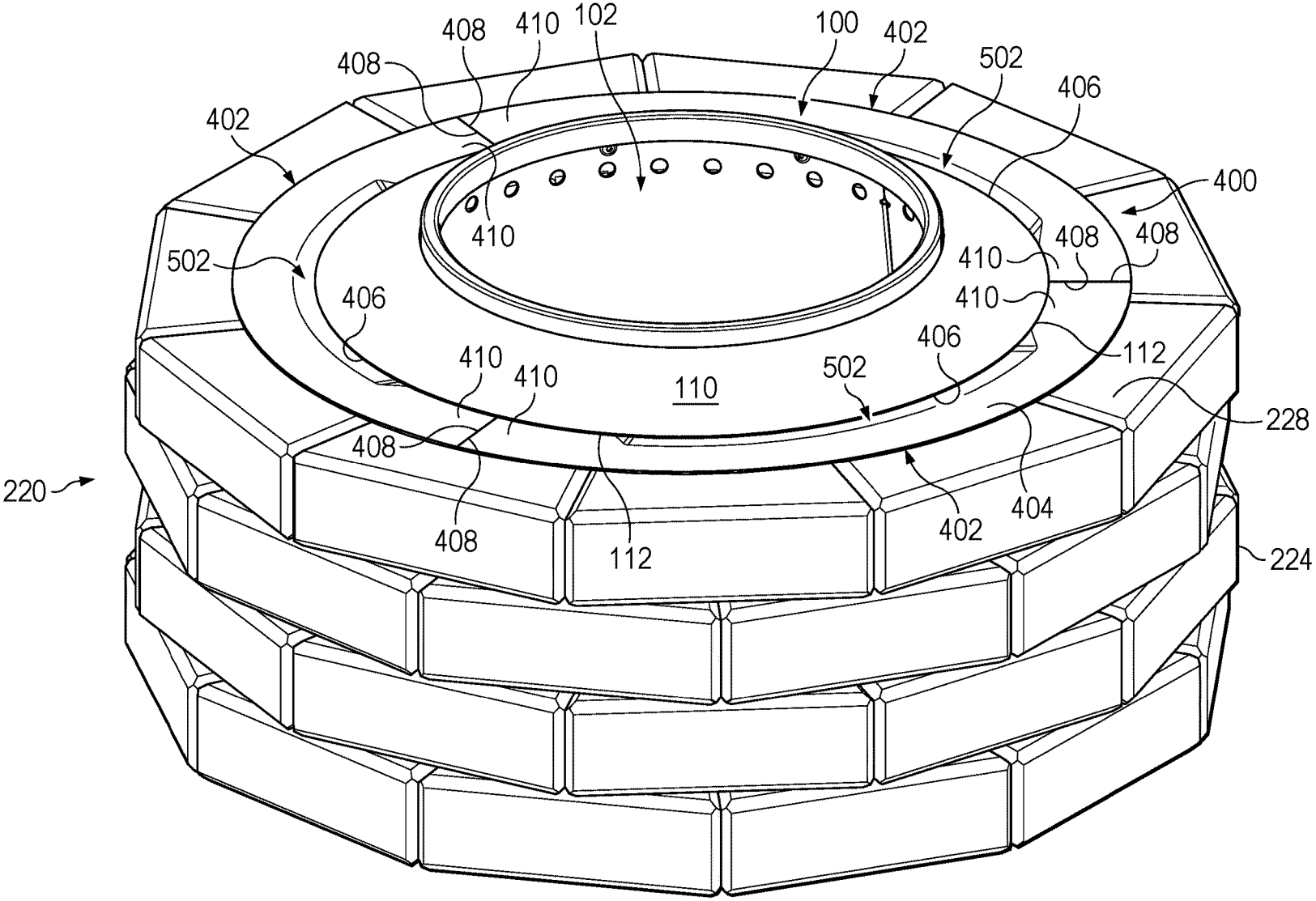
FIG. 16 is a perspective view of a masonry installation of a fire pit utilizing the fire pit ventilation ring of FIG. 16.

As there are three segments 402, a mechanism may be provided for joining the segments together to complete the insert ring 400. As shown, the opposed ends 408 are configured to receive connectors 412 where one segment 402 joins to the other. The ends 408 may be folded similar to a rail joiner such that the connector 412 is retained by each end 408 in a friction fit. The connector 412 may comprise planar piece of material allowing the ends 408 to join together in a flush manner as shown in FIG. 16. In other embodiments, the segments 408 may be permanently affixed together by, for example, being welded to the connectors 412. When assembled, or if constructed from a single circular segment, the insert ring 400 may be considered as a single panel defining a plurality of inwardly projecting support ledges 410 and defining a plurality of rebated portions 406.

As can be seen in FIG. 16, the panels 404 may be slightly sloped and may match any slope of the top cover 110. Thus, when the fire pit 100 is installed using the insert ring 400 the appearance is of a continuous shield or cover surrounding the combustion chamber 102. The operation of the insert ring 400 with respect to an operational fire pit 100 in an installation 220 is similar to the insert ring 100 described above, but for the location of the ventilation openings 502 and the more flush mounted appearance. It will also be appreciated that the rebated portions 406 and/or any outward down slope or angle of the panels 404 provide for intake air or ventilation to reach the outer wall 104 of the fire pit 100 even if the installation 220 or support structure is non-ventilated (e.g., so long as there remains space between the outer wall 104 of the fire pit 100 and the installation wall 224).

Figure 17:
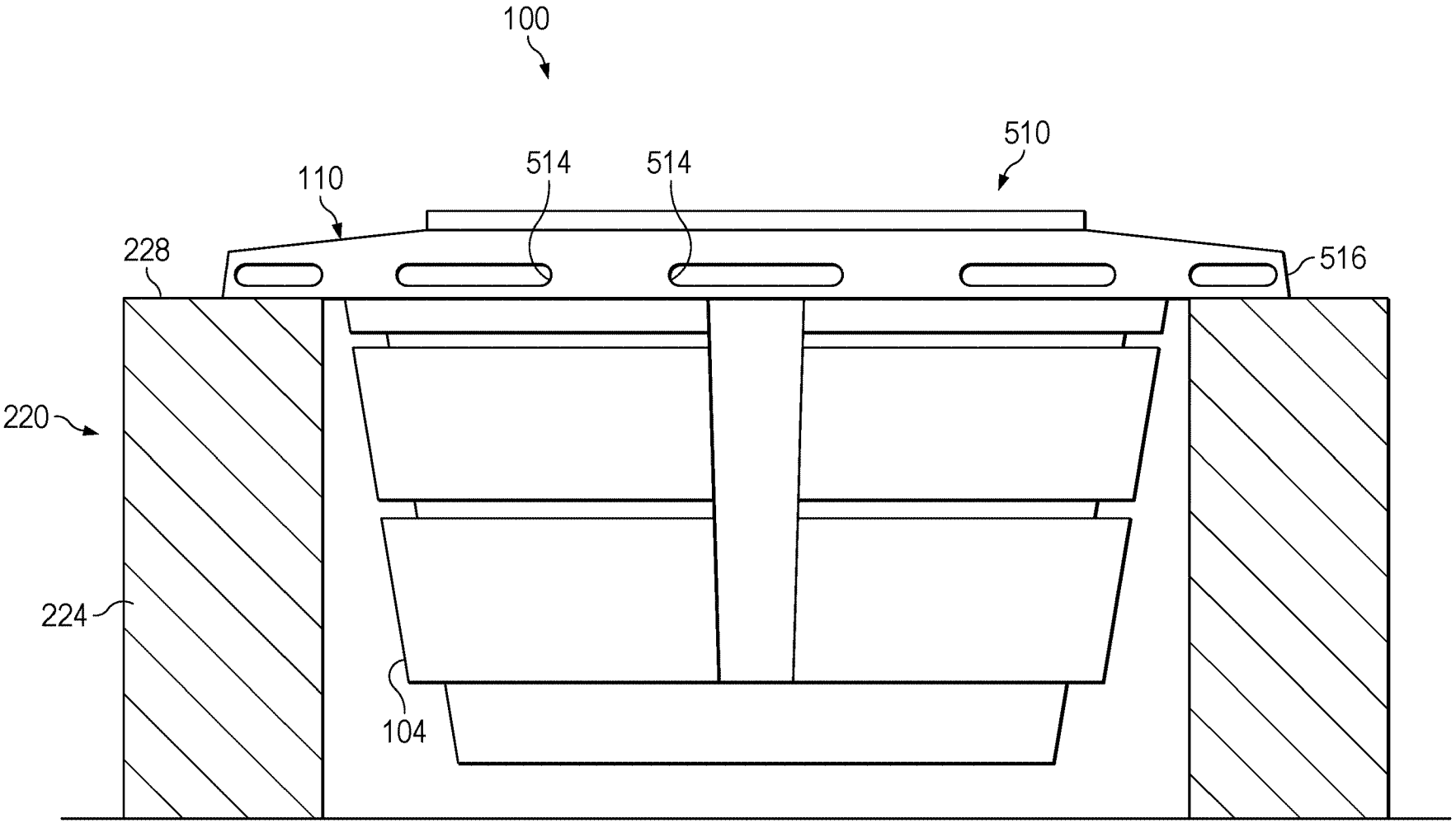
FIG. 17 is a schematic elevation view of a fire pit utilizing a top ring replacement.
Figure 18:
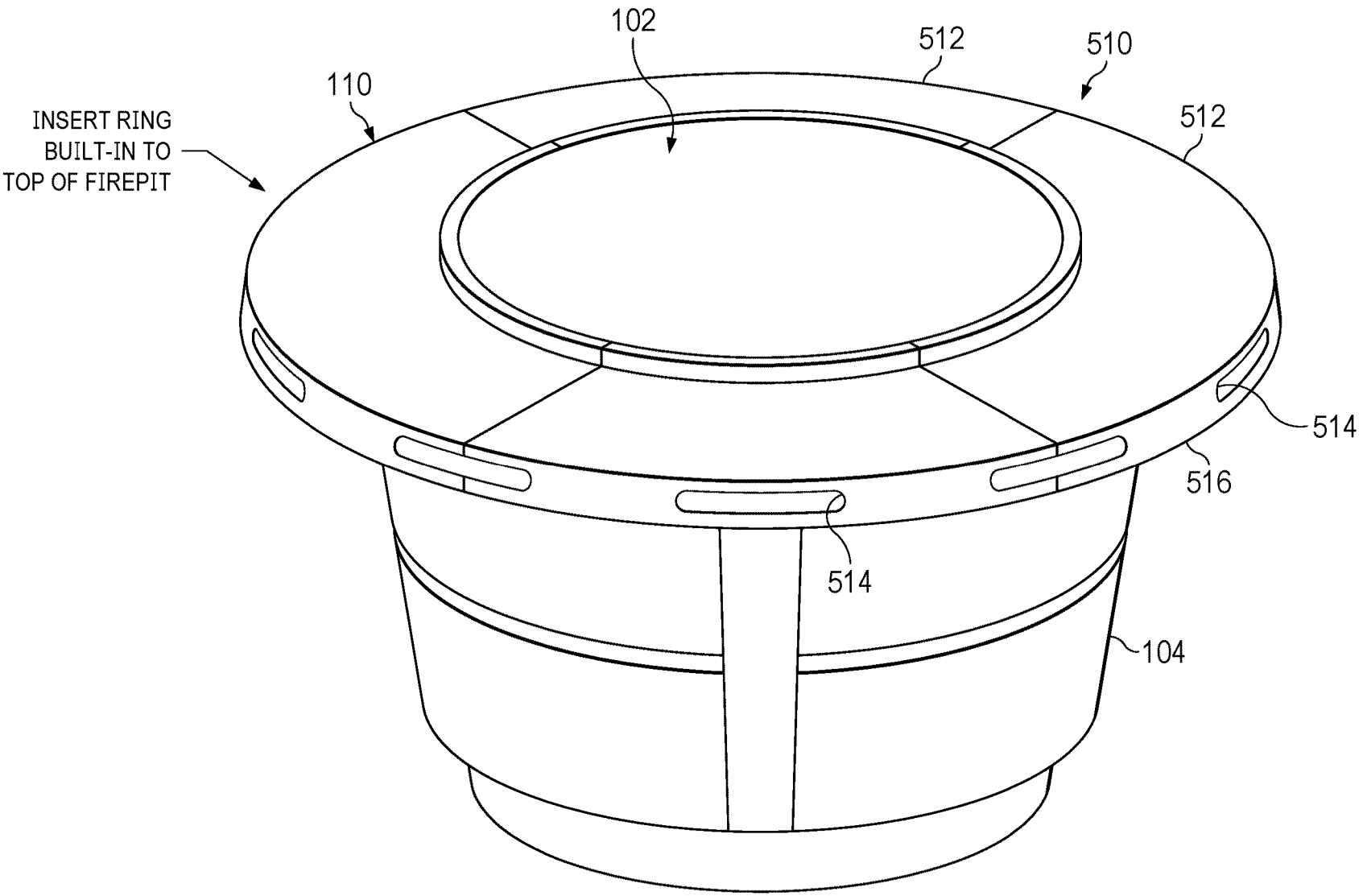
FIG. 18 is a perspective view of a fire pit of FIG. 17.

Referring now to FIGS. 17 and 18, in one embodiment, an insert top ring replacement 510 surrounds combustion chamber 102 and is supported by top or ledge 228 of installation 220. Insert top ring replacement may be constructed of multiple panels 512. Panels 512 may be slightly sloped. Thus, when fire pit 100 is installed using the insert top ring replacement 510, the appearance is of a continuous shield or cover surrounding combustion chamber 102. The operation of insert top ring replacement 510 with respect to an operational fire pit 100 in an installation 220 is similar to the insert ring 400 described above, but for the location of the ventilation openings 514, which are preferably formed in outer ring 516 of panels 512. In one embodiment, insert top replacement ring 510 carries fire pit 100, thereby maintaining lower surface 292 off of the ground.

Figure 19:
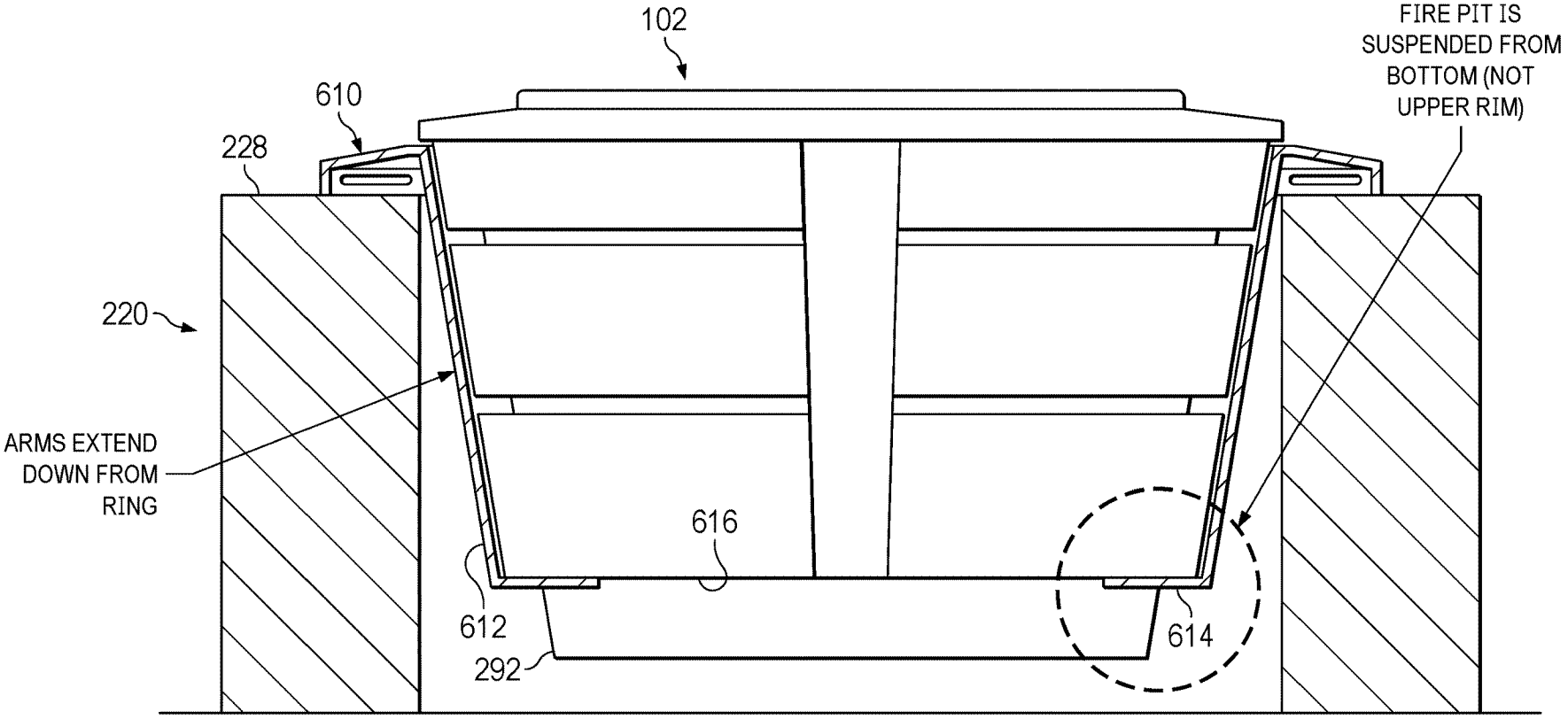
FIG. 19 is a schematic elevation view of a fire pit with a top ring and pit carrier.

Referring now to FIG. 19, in one embodiment, an insert alternate shaped ring 610 surrounds combustion chamber 102 and is supported by top or ledge 228 of installation 220. Insert alternate shaped ring 610 engages arms 612 that surround or run adjacent to fire pit 100. Arms 612 connect to bottom support 614, which extends to a location below fire pit 100 adjacent to lower surface 292. Thus, when fire pit 100 is installed using insert alternate shaped ring 610 fire pit 100 is supported from a lower portion of fire pit 100, e.g., from lower ledge 616 or from lower surface 292. In one embodiment, bottom support 614 maintains lower surface 292 off of the ground.

Figure 20:
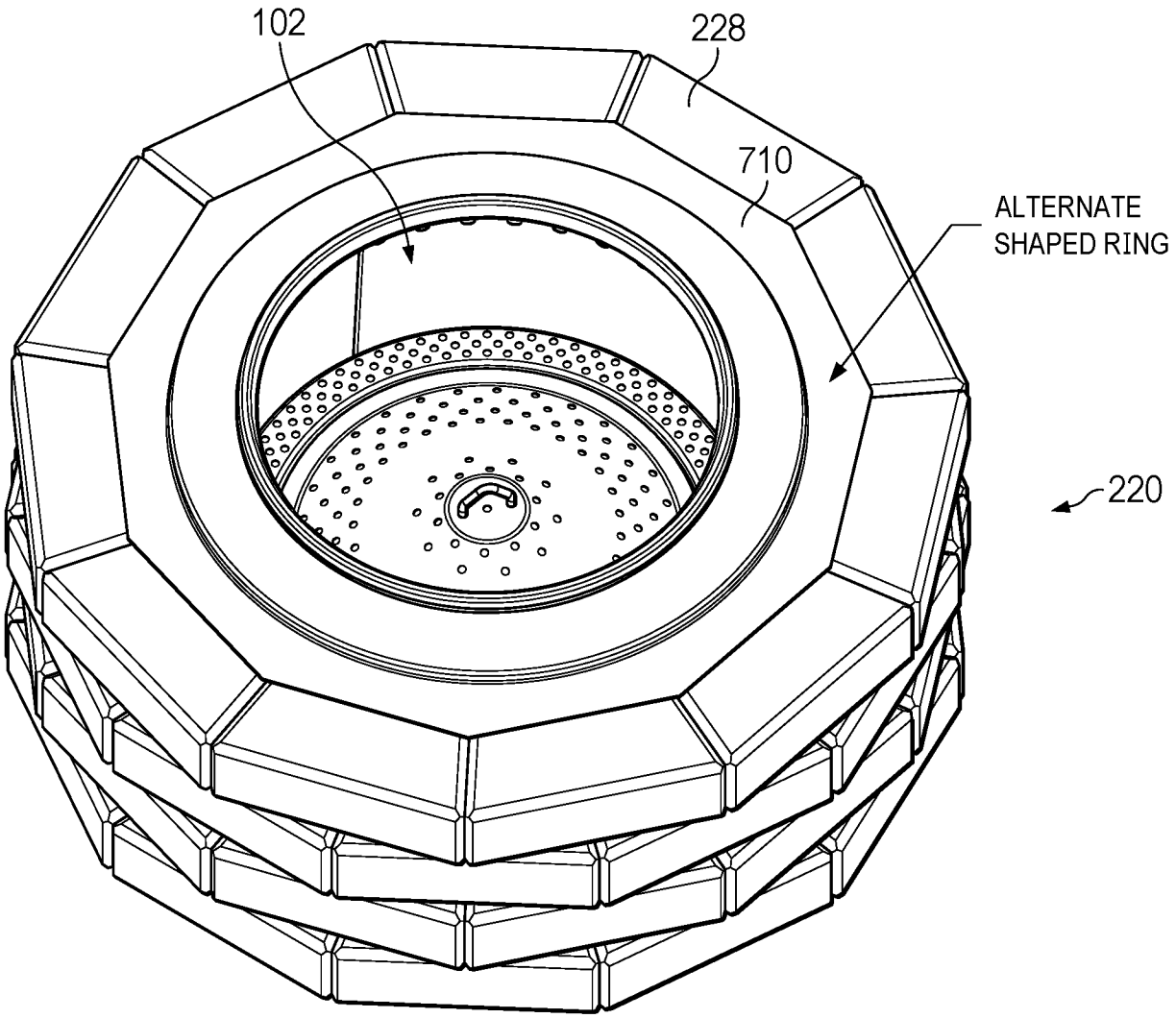
FIG. 20 is a perspective view of a fire pit having a polygon shaped ring.

Referring now to FIG. 20, shown is an embodiment wherein a non-circular or polygonal shaped ring 710 surrounds combustion chamber 102 and is supported by top or ledge 228 or installation 220.

Figure 21:
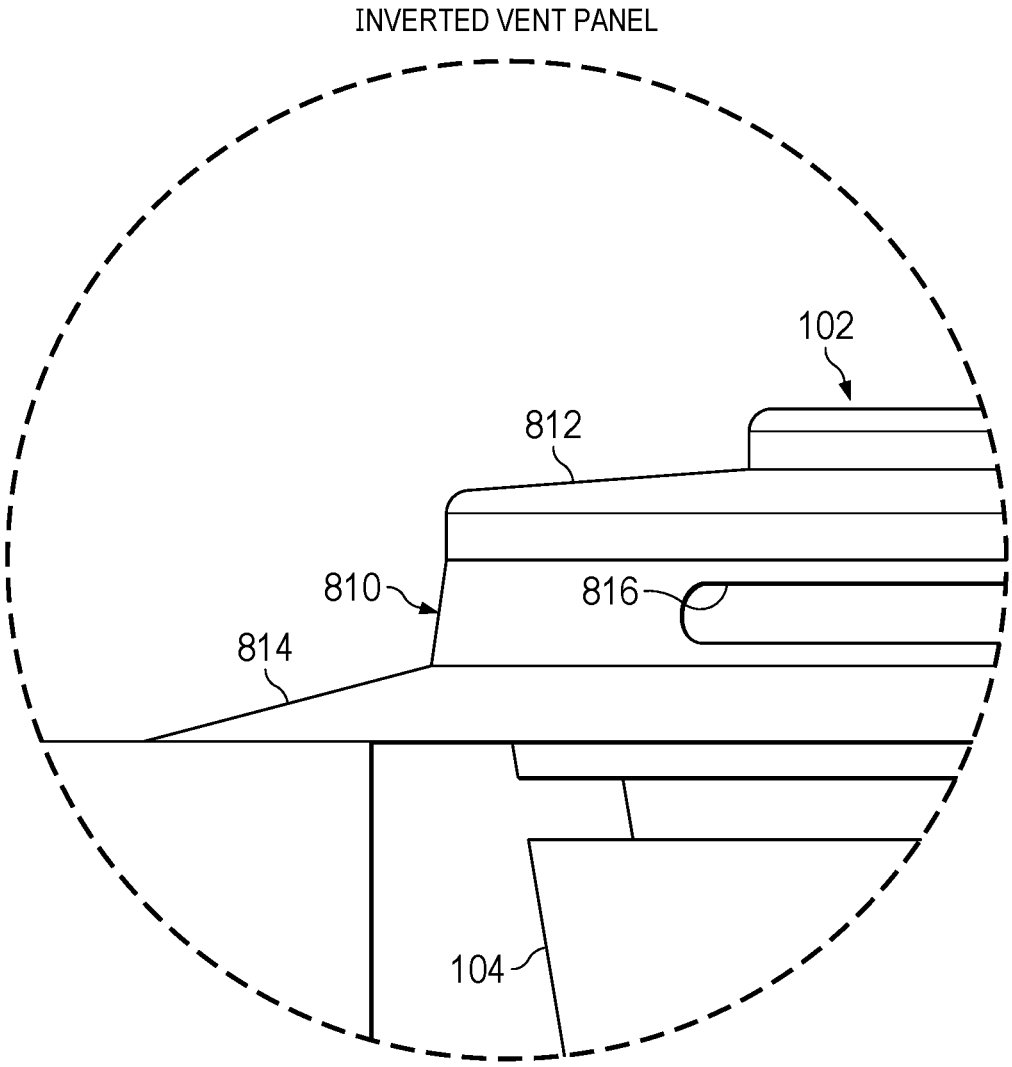
FIG. 21 is a partial elevation view of a fire pit utilizing an inverted vent panel.

Referring now to FIG. 21, shown is an embodiment utilizing an inverted vent panel 810. Cover ring 812 surrounds fire pit 100. Surround 814 is supported by top or ledge 228 of installation 220. Vent panel 810 is located between surround 814 and cover ring 812. Vent panel 810 defines a plurality of vents 816.

Figure 22:
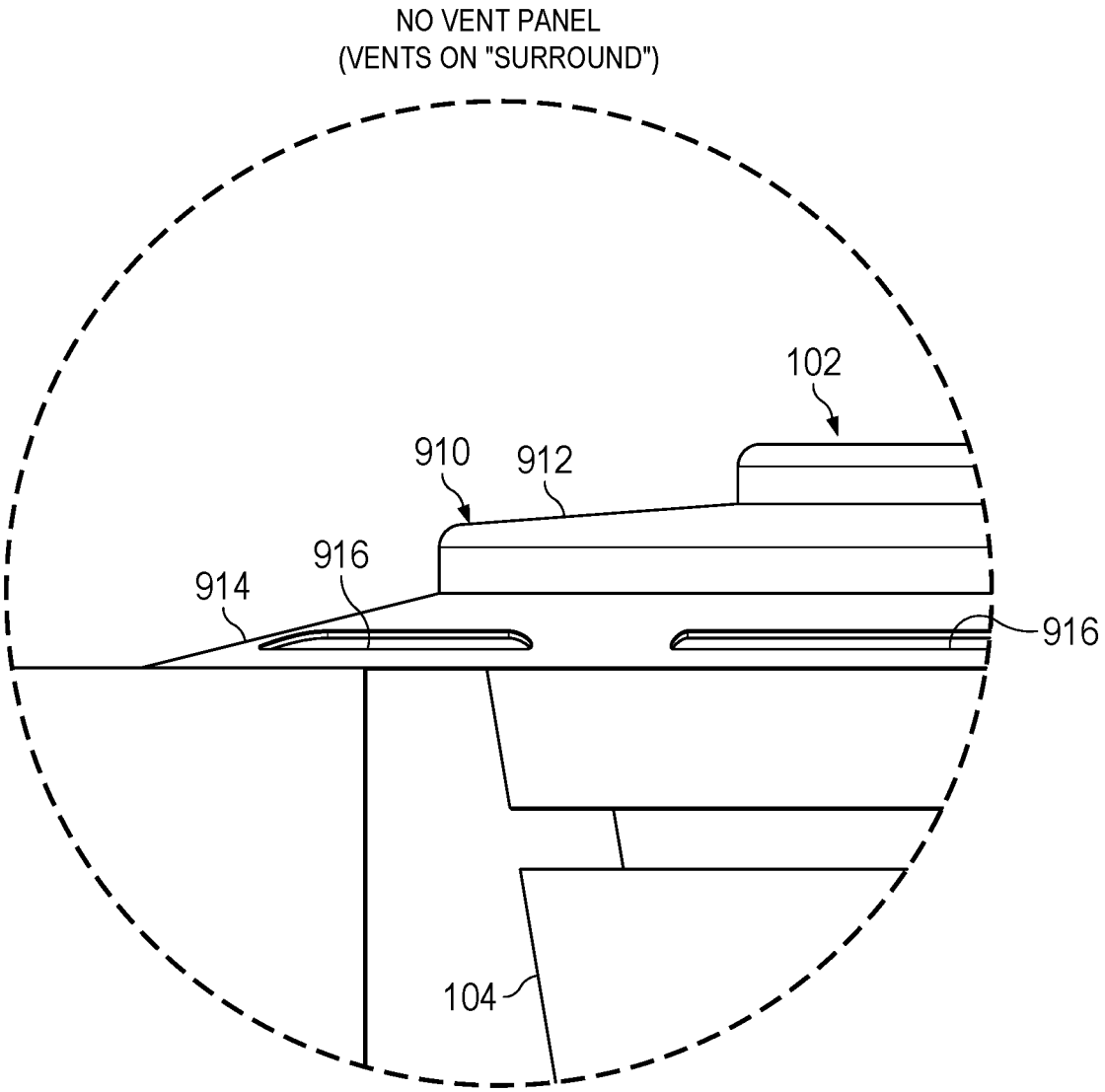
FIG. 22 is a partial elevation view of a fire pit utilizing a no vent panel.
Figure 23:
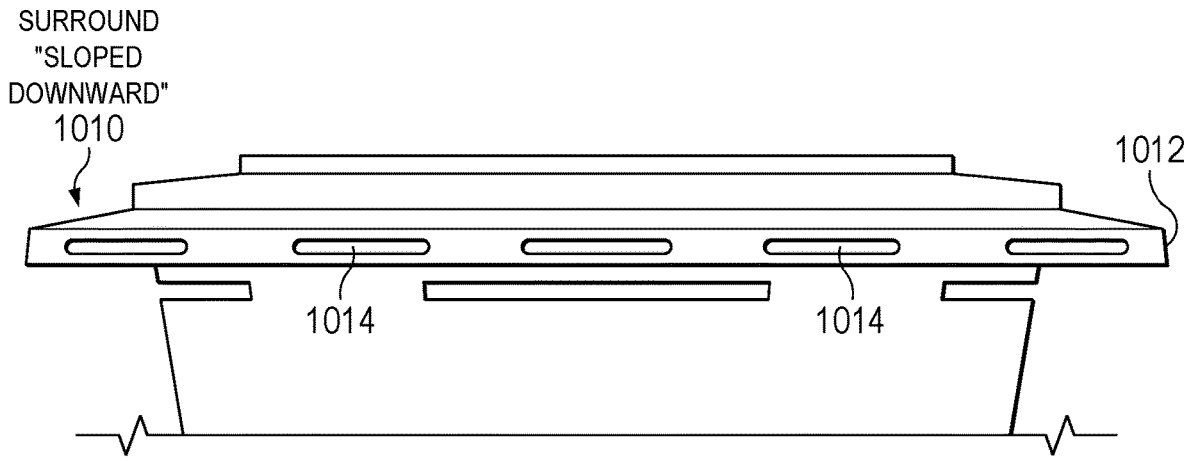
FIG. 23 is a partial elevation view of a fire pit utilizing a downwardly sloped support.
Figure 24:
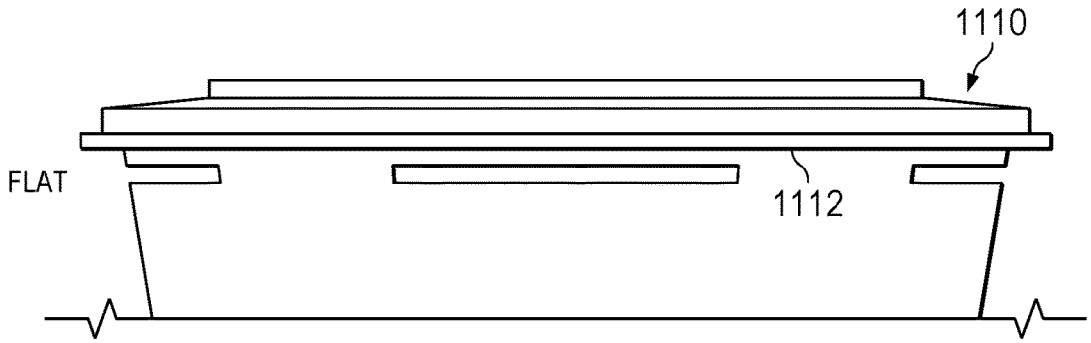
FIG. 24 is a partial elevation view of a fire pit utilizing a flat surround.
Figure 25:
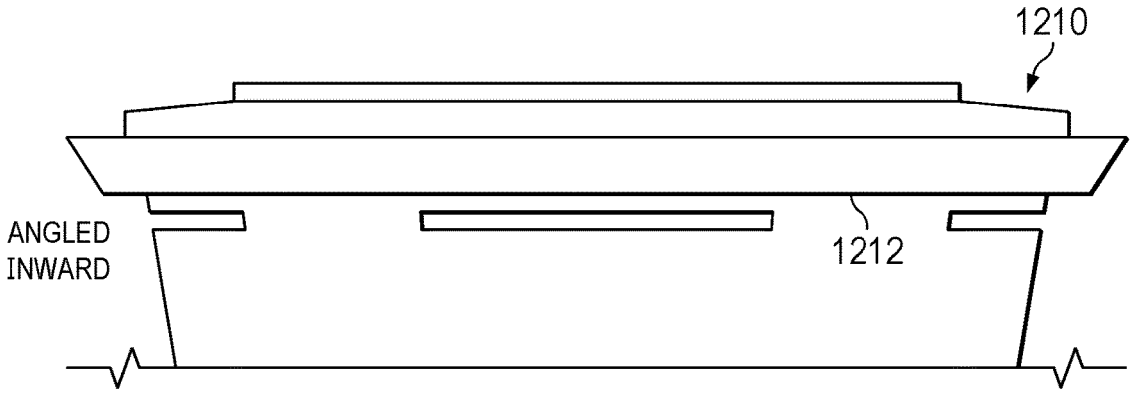
FIG. 25 is a partial elevation view of a fire pit utilizing an inwardly angled surround.
Figure 26:
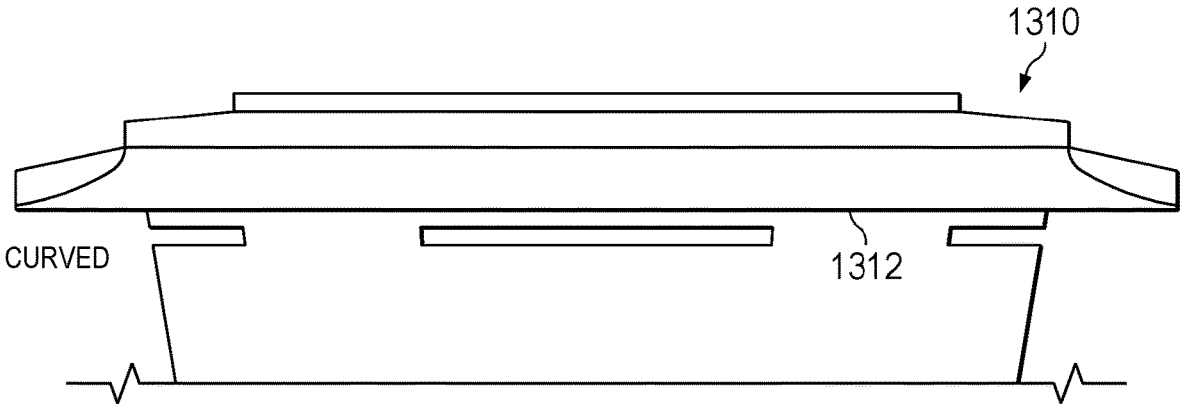
FIG. 26 is a partial elevation view of a fire pit utilizing a curved surround.
Figure 27:
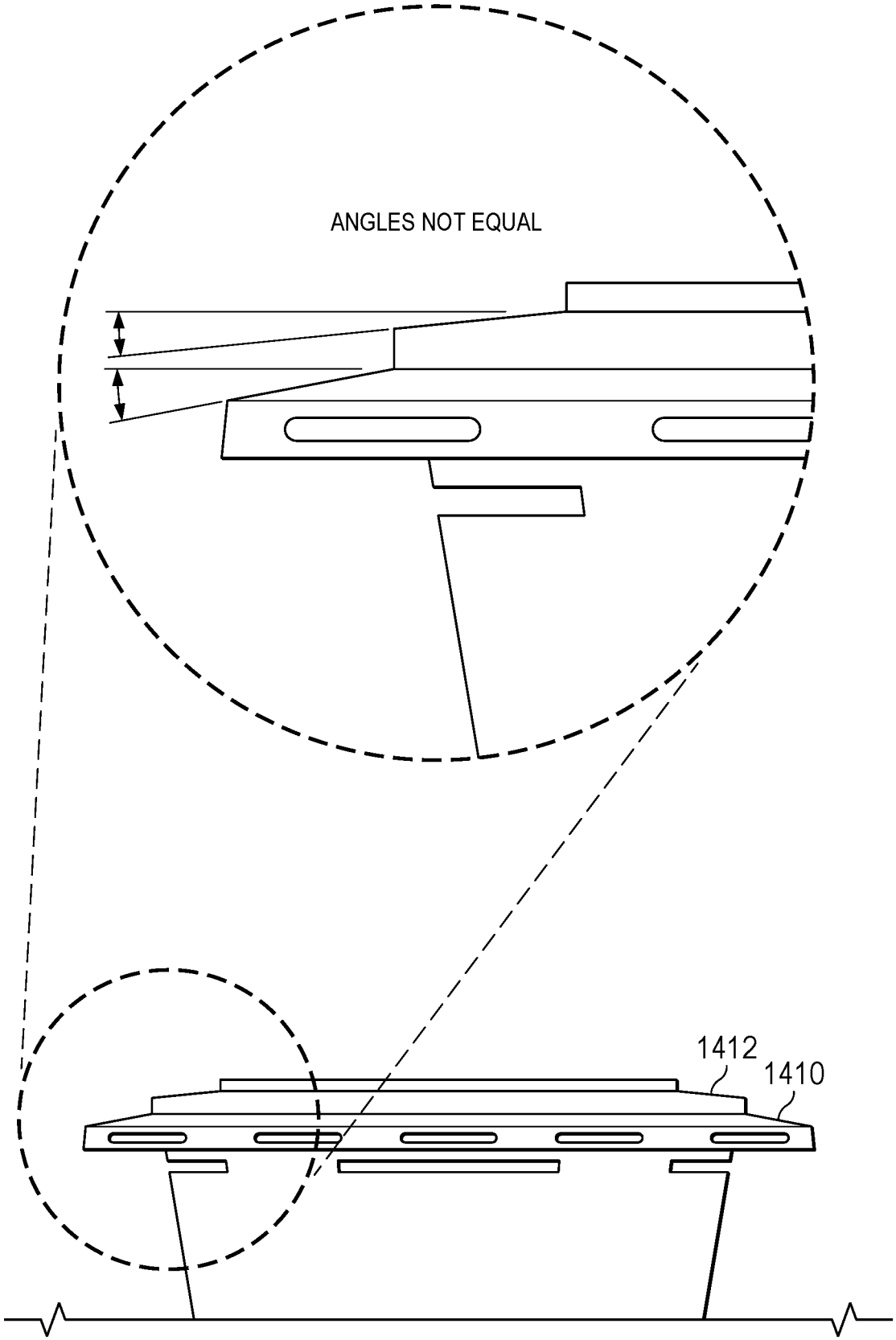
FIG. 27 is a partial elevation view and enlarged view of non-descending panels.

Referring now to FIG. 22, shown is an embodiment utilizing no vent panel 910. Cover ring 912 surrounds fire pit 100. Surround 914 is supported by top or ledge 228 of installation 220. Surround 914 is preferably angularly oriented such that a portion of surround 914 is elevated away from top or ledge 228. Surround 914 defines a plurality of vents 916. Other configurations are also possible including a surround 1010 that is sloped downwardly to a ring 1012 defining a plurality of vents 1014 (FIG. 23), a surround 1110 defining a flat lower surface 1112 (FIG. 24), a surround 1210 having a lower portion 1212 angled inwardly (FIG. 25), and surround 1310 having a curved lower portion 1312 (FIG. 26). As shown in FIG. 27, surround 1410 may possess a different slope than and adjacent ring 1412.

Figure 28:
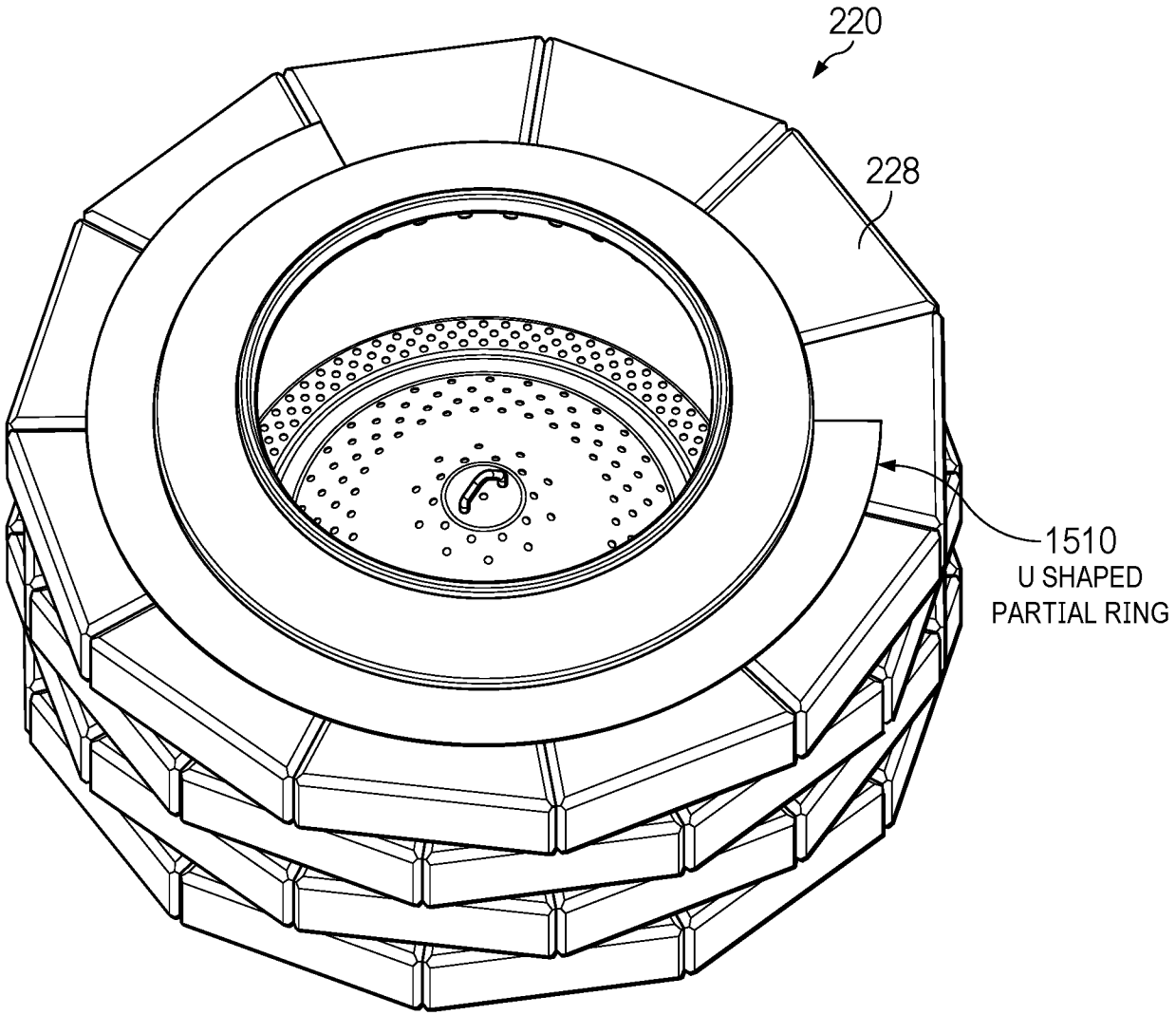
FIG. 28 is a perspective view of a fire pit utilizing a U-shaped partial ring.

Referring now to FIG. 28, shown is an embodiment wherein a u-shaped partial ring 1510 surrounds combustion chamber 102 and is supported by top or ledge 228 or installation 220.

Figure 29:
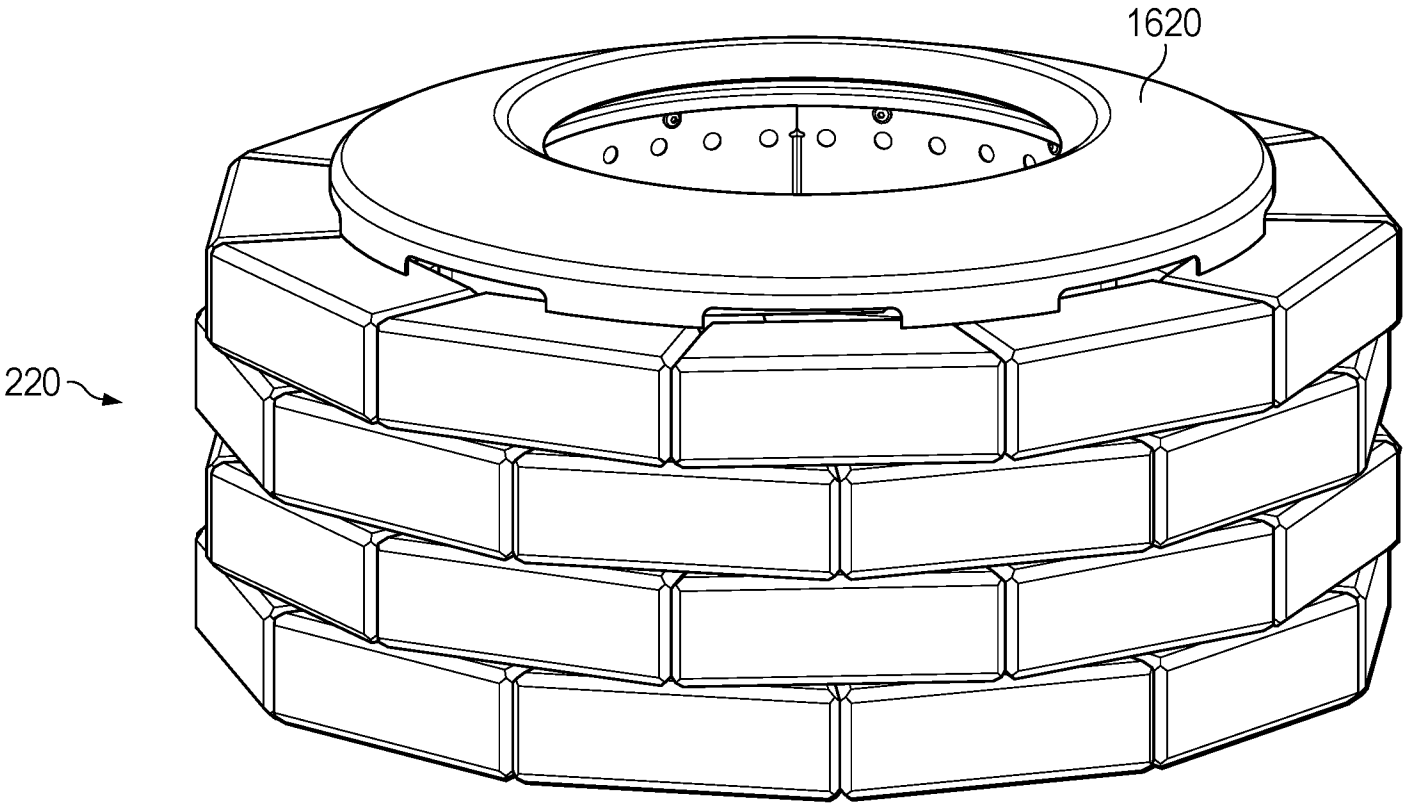
FIG. 29 is a perspective view of a fire pit with an over the top cover.
Figure 30:
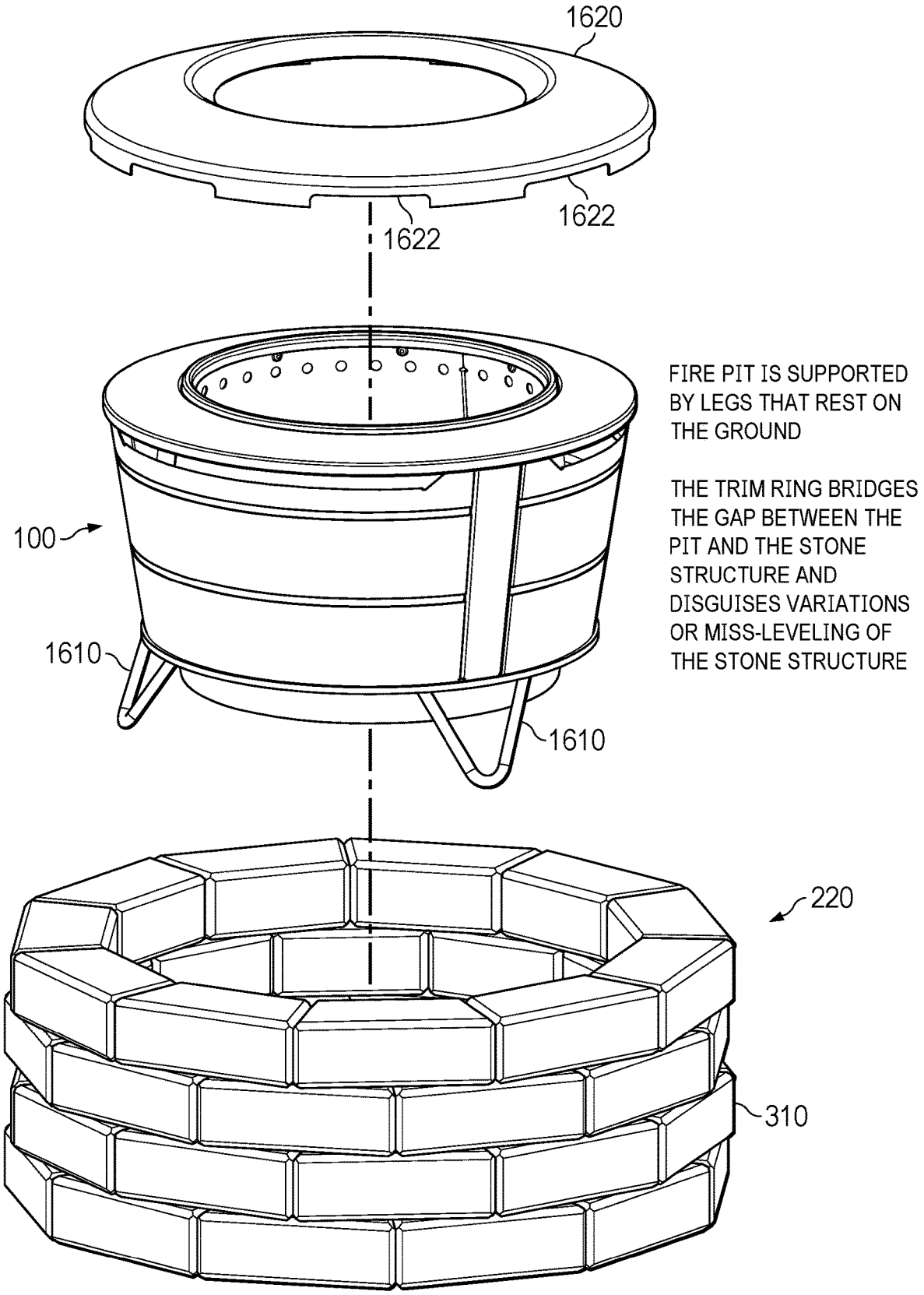
FIG. 30 is an exploded view of the fire pit of FIG. 29.

Referring now to FIGS. 29 and 30, in one embodiment, fire pit 100 is received within installation 220 and is supported on a plurality of legs 1610 that extend below lower surface 292 of fire pit 100 for supporting the fire pit. A trim ring 1620 is provided for bring a gap between installation 220 fire pit 100 for disguising variations or mis-leveling of bricks 310 that make up installation 220. Trim ring 1620 defines a plurality of rim openings 1622 for facilitating air flow therethrough.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)–(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A fire pit structure comprising:

a fire pit received in a fire pit installation;

a surround defining an opening sized to accept said fire pit; and a vent member attached to the surround and defining a plurality of vent openings;

wherein the vent member provides airflow into the installation and to an outer wall of the firepit;

wherein said vent member defines a rim for engaging an upper ledge of the installation; and wherein said rim defines a plurality of rim openings for allowing air flow therethrough.

2. The fire pit of claim 1, wherein:

a ring rests on an upper ledge of said installation, said ring connected to downwardly extending arms, said arms having a bottom support for engaging a lower ledge of said fire pit for supporting said fire pit.

3. The fire pit of claim 1, wherein:

said vent member is a vent cover; and further comprising an internal sleeved insert attached to said vent cover and descending below the vent cover, said internal sleeved insert received inside said fire pit.

4. The fire pit of claim 1, wherein:

said vent member is a vent cover; and further comprising an external sleeved insert attached to said vent cover and descending below said vent cover, said external sleeved insert received outside said fire pit.

5. The fire pit of claim 1, wherein:

said vent member is a vent cover and wherein a circumference of the vent cover is sized to rest on an upper ledge of the installation;

wherein air flow passes below said vent cover and inward toward the outer wall of the firepit.

6. The fire pit of claim 1 wherein said vent member comprises a vent panel defining a single large vent.

7. The fire pit of claim 1 wherein said vent member comprises a vent panel that defines a plurality of vents about an circumference of said vent panel.

8. The fire pit of claim 1 wherein said surround is elevated above an upper ledge of the installation for allowing air flow through a gap between said upper ledge and said surround.

9. The fire pit of claim 1 wherein:

a top cover is located above said surround;

wherein said top cover and said surround define a gap therebetween for allowing air flow therethrough.

10. The fire pit of claim 1 wherein said surround has a wave shape for creating a plurality of vents between said surround and an upper ledge of said installation.

11. The fire pit of claim 1 wherein:

said installation is comprised of a plurality of bricks; and further comprising:

a vent spacer between adjacent ones of said bricks for maintaining a space between said adjacent ones of said bricks for facilitating air flow therethrough.

12. The fire pit of claim 1 wherein said surround is polygonal shaped.

13. The fire pit of claim 1 wherein said surround is below a vent member, said surround for engaging an upper ledge of said installation.

14. The fire pit of claim 1 wherein said surround engages an upper ledge of said installation, said surround having a flat shape.

15. The fire pit of claim 1 wherein said surround engages an upper ledge of said installation, said surround having top surface having a larger diameter than a diameter of a bottom surface for defining an inward angle on a perimeter of said surround.

16. The fire pit of claim 1 wherein said surround engages an upper ledge of said installation, said surround defining a curved upper surface.

17. The fire pit of claim 1 comprising:

a cover above said surround; and wherein an upper surface of said surround and an upper surface of said cover define different angles with regard to horizontal.

18. The fire pit of claim 1 wherein said surround is U-shaped for partially surrounding said fire pit.

* * * * *